US005553952A

United States Patent [19]

Umbach

[11] Patent Number: 5,553,952

[45] Date of Patent: Sep. 10, 1996

[54] REUSABLE INK RIBBON CASSETTE FOR A LABEL PRINTER, THE CASSETTE BEING CAPABLE OF ACCOMMODATING INK RIBBONS HAVING DIFFERENT WIDTHS

[75] Inventor: Dirk Umbach, Hattingen, Germany

[73] Assignee: Esselte Meto International GmbH, Heppenheim, Germany

[21] Appl. No.: 311,259

[22] Filed: Sep. 22, 1994

[30] Foreign Application Priority Data

Sep. 24, 1993 [DE] Germany ..... 43 32 608.0

[51] Int. Cl.[6] ..... B41J 32/00

[52] U.S. Cl. ..... 400/208; 242/129.71

[58] Field of Search ..... 400/194, 196, 400/197, 207, 208, 246, 247; 242/129.5, 129.51, 129.53, 129.6, 129.7, 129.71, 129.72; 248/295.1; 403/109, 367, 368, 371

[56] References Cited

U.S. PATENT DOCUMENTS

| | | | |
|---|---|---|---|
| 4,673,304 | 6/1984 | Liu et al. | 400/208 |
| 5,073,052 | 12/1991 | Daley et al. | 400/208 |

FOREIGN PATENT DOCUMENTS

| | | |
|---|---|---|
| 0449238 | 10/1991 | European Pat. Off. . |
| 0487313 | 5/1992 | European Pat. Off. . |
| 141816 | 5/1983 | Germany . |
| 3426752 | 1/1986 | Germany . |
| 3723279 | 1/1988 | Germany . |
| 4041991 | 7/1992 | Germany . |
| 2263896 | 8/1993 | United Kingdom . |

*Primary Examiner*—Ren Yan
*Attorney, Agent, or Firm*—Nils H. Ljungman and Associates

[57] ABSTRACT

A reusable ribbon cassette can be provided for a printer for printing on labels by using an ink transferred from the ribbon to the label material, wherein the ribbon cassette provides the ribbon for the printing. Such a re-usable cassette for a ribbon which is used up rapidly, in particular an ink ribbon in a thermal transfer printing process, has two parallel housing halves, one of which has vertically projecting pins onto which the other housing half can be pushed, and then maintained in position by friction. When the cassette is open, the tape, which is conventionally wound on a tape core, can be pushed onto the cores or core pairs of the cassette, and thereby become simultaneously non-rotationally connected to the cores. The connecting pins for the two housing halves advantageously simultaneously form deflector elements for the tape. The deflector pins are also detachable, so that the pins can be replaced by shorter or longer ones, thereby making it possible to use a narrower or wider tape for the cassette. The cores, or at least one core per core pair, can be coupled to the corresponding shaft by means of internal and external teeth, whereby one of the shafts is a drive shaft.

24 Claims, 8 Drawing Sheets

FIG. 12
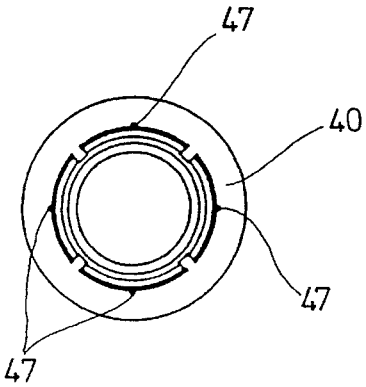
FIG. 8
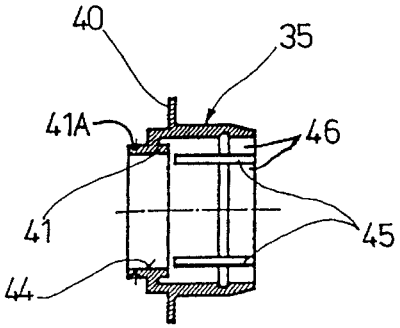
FIG. 9
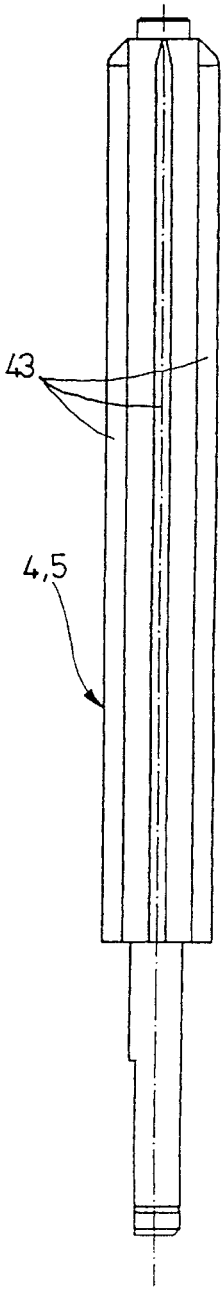
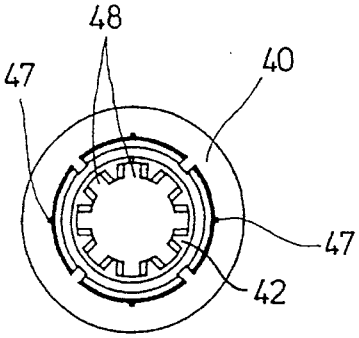
FIG. 10
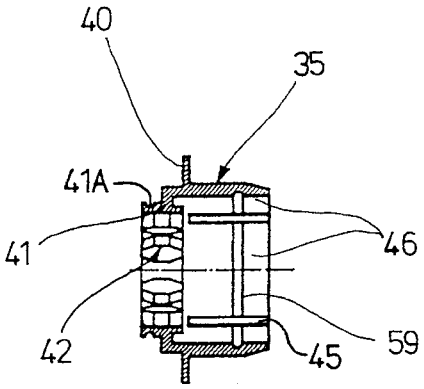
FIG. 11
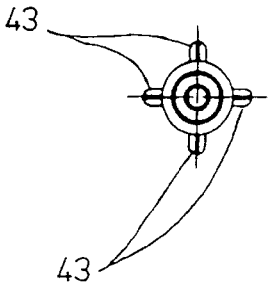
FIG. 13

REUSABLE INK RIBBON CASSETTE FOR A LABEL PRINTER, THE CASSETTE BEING CAPABLE OF ACCOMMODATING INK RIBBONS HAVING DIFFERENT WIDTHS

BACKGROUND OF THE INVENTION

1. Field of the Invention

The present invention generally relates to an ink ribbon cassette for a label printer, such as a label printer for printing self-adhesive labels, wherein the printing substance is provided by a ribbon to the area adjacent the print head. More specifically, the present invention relates to a reusable printer ribbon cassette which is capable of accomodating ink ribbons having different widths. Such a cassette can have two internally toothed, connectable cores having parallel geometric axes, disposed at a lateral distance from one another and able to rotate in a housing or similar enclosure. Each of the cores can be provided with a shaft, and the shafts can be provided with drivers, whereby one of the shafts can be a drive shaft and the ribbon, or tape in general, can be unwound from the one core and wound up on the other core.

2. Background Information

Millions of cassettes of the type described above have been used for many years as audio cassettes, video cassettes or ink ribbon cassettes for typewriters and printers. But there are other materials in the form of tapes, ribbons or strips which could be handled more easily if a cassette could be designed for the desired use. Such tapes, for example, include ribbons coated with ink, e.g. like those used in thermal transfer printing. In known tape storage devices, the entire ribbon is wound onto a core which is inserted over a corresponding mandrel of the machine. The leading end of the ribbon must then be threaded through the machine and fastened to a take-up core. Depending on the configuration through which the ribbon must be fed, this process can undoubtedly be difficult and time-consuming, quite apart from the fact that the tape or ribbon can be damaged in the process.

OBJECT OF THE INVENTION

The object of the present invention is therefore to improve a cassette of the type described above so that it can be used for other tapes, in particular significantly wider tapes, e.g. like ink tapes used in thermal transfer printing of wider labels, so that the insertion of a new ribbon into a printer becomes an easy, and user-friendly operation.

SUMMARY OF THE INVENTION

The invention teaches that this object can be accomplished by means of a cassette having two internally-toothed cores having parallel geometric axes, which cores can rotate at some lateral distance from one another in a housing or similar enclosure and wherein the housing preferably has two parallel housing halves. These housing halves are preferably detachably connected to one another by means of at least two pins retained on the first housing half, whereby the geometric axes of the pins can preferably run parallel to the geometric axes of the cores, and wherein the two cores are rotationally mounted on one of the housing halves, e.g., on the second housing half, and the at least two pins form deflector elements for the usable strand of the tape.

The tape itself which can be used in such a cassette, can preferably be a tape supported on a conventional core-shaped support. Such a core-shaped support can preferably be installed in the opened cassette simply by inserting the core-shaped support onto the core of the cassette. The leading end of the tape can preferably be fastened in a known manner to a second, or take-up core. The tape can also be guided in the cassette in a known manner, and can preferably be guided by at least two deflector pins, or guide elements. Here, too, the usable portion of the ribbon, i.e. the portion of the ribbon which, on a printing machine, is pressed against the printing, or pressure, roller by means of a print head, can preferably be located between the two deflector elements.

The loaded cassette, or cassette containing a ribbon, can preferably be inserted as a unit into the machine. In the remainder of this application, it is assumed that the machine in question is a printer, although the use of the cassette claimed by the invention is not meant to be restricted to only such a machine.

A printer which can utilize such a cassette can preferably have a corresponding holder for the cassette, so that the cassette can be placed in the correct position in relation to the printing roller or similar device, and also, so that the cassette can be held securely in the machine. In general, a simple insertion of the cassette into the cassette holder can preferably position and align the ribbon therein with the print head.

The cassette need not have a substantially completely closed housing, but while a completely enclosed housing might be desirable in some instances, one configuration as provided by the present invention can use a relatively simple, open housing. Such a simple open housing can essentially be formed by two parallel halves of the housing and pins extending between the two housing halves. The housing halves are preferably disposable with respect to one another so that the distance between the two halves of the housing can essentially correspond to the width of the tape.

The guide pins can preferably be permanently connected to one of the housing halves, preferably to the first housing half. Thus, the cassette in accordance with the present invention can essentially simply be opened by pulling the second housing half away from the first housing half, or away from the ends of the pins. Once the cassette is opened, the tape can preferably be loaded into the cassette. To close the housing, the second housing half can then preferably simply be pushed back onto the ends of the pins in a direction towards the first housing half. The second housing half can then preferably be held in a non-fastened manner, such as by friction, or alternatively by some sort of locking mechanism.

On the printing machine, as on other audio and video tape players, there can preferably be two parallel, externally-toothed shafts equipped with drivers. One of the shafts would typically be a drive shaft, while the other shaft would function more like a brake shaft, the function of which can preferably be to apply a proper tension to the ribbon. The interlocking connection between the shaft, which shaft can preferably have a star-shaped cross section, and the matching, internally-toothed core, can preferably be made by inserting the cassette over the two shafts, one core over each shaft. The cores of the housing can preferably be mounted so that they can rotate on one of the housing halves, preferably the first housing half, so that when the drive shaft rotates, the drive shaft also drives the connected core, and thus pays out the tape through the cassette.

Any tape which is then unwound, can then essentially be kept taut by means of the second core, which second core can preferably be coupled to the "brake shaft", and is wound up by means of the first core.

In one refinement of the invention, there can also preferably be a second core for each shaft. This second core can preferably be mounted on the second housing half. With two cores, the tape can essentially always be located between two cores which are coaxial to one another at some axial distance from one another. Instead of a single, long core, two short cores per shaft can be advantageously used, whereby with a wide tape, the axial distance between the cores can be a multiple of the length of the core. In any case, the provision of two cores can provide a configuration with a dual bearing for each shaft. Such a dual bearing can essentially guarantee correct operation.

An additional and altogether special advantage of having two cores is that the second housing half can then preferably be pushed along the pins to a greater or lesser depth. This type of positioning can make it possible to use tapes of different widths. If only one long core Here to be used instead of a second coaxial core, this feature of the flexibility in positioning can not be possible in all configurations.

The second housing half can preferably advantageously be held friction-tight on the pins. For this purpose, there can preferably be some sort of friction coating, or member, disposed on the housing half, or the pins in the location of the engagement between the pins and the housing half. Thus, in one possible embodiment of the present invention, the pins, which can be made of metal can preferably be coated with a friction material, such as a plastic, so that the plastic surface thereof can frictionally engage receiving holes in the second housing half. Alternately, the inner surface of the receiving holes could be coated, instead of, or possibly in addition to the coating on the pins. It might also be conceivable that the entire pin could be constructed of such a friction material, i.e. a hard plastic. In an additional configuration of the present invention, for the frictional engagement, there can preferably be a bushing held on the housing half for each pin opening. Such a bushing can preferably be a plastic bushing, e.g. made of polyethylene. By means of a suitable selection of materials and tolerances, it can thereby be possible to clamp the housing halves in any desired position due essentially to the frictional engagement between the pins and the bushings through which the pins pass. The depth of insertion of the second housing half onto the pins can preferably then be a function of the width of the tape or, if the tape is on a core, of the length of the core.

One particularly preferred embodiment of the present invention can be provided by an embodiment in which, both on the tape payout side, and on the tape take-up side, there are preferably two deflector elements located at some distance, one behind the other, in the direction of travel of the tape. The strands of the tape located between two corresponding deflector elements can thereby preferably run at approximately right angles to the usable strand of the tape between them. The use of two deflector elements per winding has the major advantage that both an externally-wound ribbon and an internally-wound ribbon can then be used. In both cases, the tape can run through the cassette in the desired direction, and the coated surface of the ribbon can always be on the outside. The only difference is that the winding of the paid-out tape, with an externally-wound ribbon, turns in the other direction than with an internally-wound ribbon.

It is preferable if all the deflector elements are also formed by pins, which pins can be similar in design to the guide pins. Then, in addition to the task of deflection of the tape, the deflection pins could also preferably be used to fasten the detachable second housing half to the first housing half.

An additional important variant of the invention can be provided by an embodiment in which the cores are preferably designed as two-piece components. As such, the core can have an inner, essentially sleeve-shaped base part and a ring-shaped retaining part connected or detachably connected to the base part. The sleeve-shaped base part can preferably be configured to at least indirectly hold the corresponding end of the tape, and the ring-shaped retaining part can preferably be disposed in contact with the outside of the housing half. As a result of the two-piece design of the cores, the cores can preferably be easily fastened to the corresponding housing halves. Such a simple attachment can result in reduced manufacturing costs.

In another preferred variant, it can be desirable that only one of the sleeve-shaped base parts for each shaft has internal gear teeth. As such, the two toothed guide shafts of the printer can each be connected in an interlocking manner to preferably only one of the two coaxial cores, with the shaft merely running through the other core. It is also preferable that the toothed strips of the toothed shaft preferably extend into the hole of the untoothed base part, so that bearing support can also be provided at that point.

An additional advantageous configuration of the present invention can be provided by a configuration in which the core-shaped base parts are preferably provided on their surface with several radially-projecting retaining elements. These retaining elements can preferably be uniformly distributed over the circumference, and can preferably be configured as buttons, webs or similar structures, which can be placed in a frictional or interlocking connection with an elastically flexible tape core, preferably made of cardboard, which holds the tape. As such, the radially-projecting retaining elements, which can, in particular be configured as narrow, low webs, can be engaged by the core holding the tape material, during insertion of the core into its hole or inner wall. Thus, it can be possible to create an interlocking fit, a friction fit or a force-fitted connection between the tape core and the cassette cores.

The two parts of each core, that is, the sleeve-shaped base part and the ring-shaped retaining element can be held to one another and to the corresponding housing half by means of a retaining element, preferably a retaining ring.

In another refinement of the present invention, it can be advantageous if the machine has a locating pin on which the cassette can be inserted. The cassette, as described above, can then preferably be provided with a corresponding locating hole and can be inserted over the drive shaft and the brake shaft. On account of this three-point bearing system, the cassette and its working strand can preferably be correctly oriented in relation to the other elements of the machine and/or to the printing roller of the printer. The two housing halves of the housing can preferably be designed so that the two halves are identical, with the exception of the upper portion, wherein the one housing half, in the upper portion is larger in the center to create room for a passage for the locating pin. In addition, a further bearing bushing could preferably be inserted into the passage formed by the locating hole.

Another particularly advantageous variant of the present invention can be provided by an embodiment in which there can preferably be a sliding collar provided on the locator pin. This sliding element, or collar can preferably be moved and fixed in place. The second housing half can then preferably be placed and maintained in position on the locator pin of the machine by means of the sliding collar.

Such a sliding collar can thus make it possible not only to use cassettes of different widths, but also to create a correspondence, or relationship, between the cassette and a clearly-defined segment of a printing, or pressure roller which exceeds the width of the ribbon. It is also possible to install two narrow cassettes next to one another and to print simultaneously with two ribbons, in particular ribbons of two different colors.

If narrow ribbons are used to reduce the cost of the print ribbons, these ribbons can also preferably be held by the cassette of the present invention, whereby the cassette can be oriented by means of a sliding collar which can be axially moved and fixed in place on the locator pin so that the narrower print ribbon can be positioned in the area to be printed.

The cassette can also preferably be provided with two arms extending away from the guide pins, and one of the deflector pins can preferably be positioned adjacent an end of each of the arms. Such a cassette can then be suitable for special applications because such a cassette can offer sufficient space between the two arms for receiving a printing head of a printer. The printing head can be located, under suitable conditions, between the rear side of the working strand of the ribbon and the two cassette arms.

One particularly preferred embodiment preferably has, in the vicinity of at least one of the deflector elements, a guide plate for the ribbon. This guide plate preferably projects forward beyond the housing, and can preferably be mounted on one of the deflector pins so that the guide plate can be swivellable about the deflector pin. By means of this guide plate, the working strand of the ribbon can be pulled somewhat further out of the cassette at the point in question. This ability to position the ribbon away from the deflector pin can make possible a larger angle of wrap on the printing, or pressure roller and thus can allow for higher print speeds to be achieved, as the ribbon can be moved faster past the printing roller. It is thereby of particular advantage that each guide plate be mounted so that it can pivot on the housing, in particular on the corresponding pin-shaped deflector element.

It can also be preferable that the guide plate, in a retracted position, projects laterally beyond the side of the housing. In instances when the cassette is inserted into the printer, there is a danger that the working strand of the ribbon will project so far beyond the corresponding free end of the arm that it can become snagged on the printing roller, and cause damage to the ribbon. To prevent such an occurrence, the guide plate can preferably be moved into a retracted position, in which the ribbon, if necessary, preferably projects laterally beyond the related arm of the cassette, which could be a position which is relatively unproblematic for the insertion of the cassette, in terms of the risk of damage to the ribbon. Of course, the arm can also be made suitably wide, so that the ribbon, in the inactive angular position of the guide plate, preferably does not project outward at all. But for ease of operation, it is more efficient if the cassette is designed so that the guide plate does project laterally when retracted.

If the cassette is a reversible cassette, which, after the entire tape has run through, can be turned over and the ribbon reused, the other arm of the cassette would then correspond to the printing roller, and consequently a guide plate, or deflector element, would then be required on the other arm. Therefore, either a guide plate can be provided on each cassette arm, or the guide plate can be designed so that it can preferably be moved from one arm to the other.

When the word invention is used in this specification, the word invention includes inventions, that is, the plural of invention. By stating invention, the applicant does not in any way admit that the present application does not include more than one patentably and non-obviously distinct invention, but that this application may include more than one patentably and non-obviously distinct invention. The Applicant hereby asserts that the disclosure of this application may include more than one invention, which in the event that there is more than one invention, that these inventions may be patentable and non-obvious, one with respect to the other.

One aspect of the invention resides broadly in a reusable ribbon cassette for a printer for printing labels on a label material, the cassette being capable of accomodating ribbons having different widths, the printer being configured for transferring a printing substance from a printing ribbon to the label material, the printer comprising: apparatus for storing label material to be printed upon; apparatus for storing printing ribbon, the printing ribbon comprising a printing substance thereon; at least one printing element for printing on the label material, the at least one printing element comprising apparatus for transferring the printing substance from the printing ribbon to the label material; apparatus for actuating the at least one printing element to transfer printing substance from the printing ribbon to the label material to print on the label material; and the apparatus for storing printing ribbon comprising the reusable cassette; the reusable cassette comprising: a first housing portion; a second housing portion; the first and second housing portions comprising apparatus for holding a supply of printing ribbon therebetween; at least first and second support shaft apparatus, the first and second support shaft apparatus being spaced apart from one another and extending at least between the first and second housing portions for variably positioning the first and second housing portions with respect to one another to accomodate printing ribbons of different widths therebetween; the first support shaft apparatus having a first end adjacent the first housing portion and a second end, the second end comprising a portion adjacent the second housing portion; the second support shaft apparatus having a first end adjacent the first housing portion and a second end, the second end comprising a portion adjacent the second housing portion; at least one of the first housing portion and the second housing portion comprising corresponding openings for receiving the first and second support shaft apparatus therethrough for relatively positioning the first and second housing portions with respect to one another; the first and second support shaft apparatus disposed through the corresponding openings comprise a frictional engagement between the first and second support shaft apparatus and the openings; and the frictional engagement between the first and second support shaft apparatus and the corresponding openings being sufficient for substantially minimizing movement of the first and second housing portions with respect to one another.

Another aspect of the invention resides broadly in a cassette fo a printer for printing labels on a label material by transferring a printing substance from a printing ribbon to the label material, the printer comprising at least one print element for transferring the printing substance from the printing ribbon to the label material, the cassette for accomodating printing ribbons having different widths, the cassette comprising: a first housing member; a second housing member; at least one of the first housing member and the second housing member comprising a portion for frictionally engaging the other of the first housing member and the second housing member for relatively positioning the first housing member with respect to the second housing member and for defining a distance between the first and second housing members, the distance corresponding to the width of the printing ribbon; and the portion for frictionally engaging and the frictionally engaged one of the first housing member and the second housing member defining a friction therebetween, the friction between the portion for frictionally engaging and the frictionally engaged one of the first housing member and the second housing member providing at least a substantial portion of a force for maintaining the first housing portion and the second housing portion in a substantially fixed position with respect to one another.

Another aspect of the invention resides broadly in a method for using a ribbon cassette to accomodate ink ribbons having different widths, the ribbon cassette comprising a first housing portion, a second housing portion, and at least first and second support shaft apparatus extending at least between the first and second housing portions for variably positioning the first and second housing portions with respect to one another; at least the second housing portion comprising apparatus for frictionally engaging the first and second shaft apparatus; the method comprising the steps of: engaging the first and second shaft apparatus with the first housing portion; mounting the second housing portion on the engaged first and second shaft apparatus of the first housing portion; positioning at least a supply spool of ink ribbon between the first housing portion and the second housing portion, the supply spool of ink ribbon having a width; overcoming the frictional engagement to slidably move the second housing portion along the first and second shaft apparatus to position the second housing portion a distance from the first housing portion, the distance corresponding to the width of the supply spool of ink ribbon; and further frictionally engaging the first and second shaft apparatus with the second housing portion to maintain the distance between the first and second housing portions.

BRIEF DESCRIPTION OF THE DRAWINGS

Additional configurations of the cassettes in accordance with the present invention, their operation and advantages, are disclosed further herebelow with reference to the drawings, in which:

FIG. 8 is a plan view on an enlarged scale of the base of one of the two cores;

FIG. 9 is a longitudinal center section through the base body of FIG. 8;

FIG. 10 is a plan view of the other base body of the cores;

FIG. 11 is a longitudinal center section through the base body illustrated in FIG. 10;

FIG. 12 is a plan view of the drive shaft corresponding to the cores;

FIG. 13 is a plan view of the drive shaft illustrated in FIG. 12, from the right;

DESCRIPTION OF THE PREFERRED EMBODIMENTS

Figure 1:
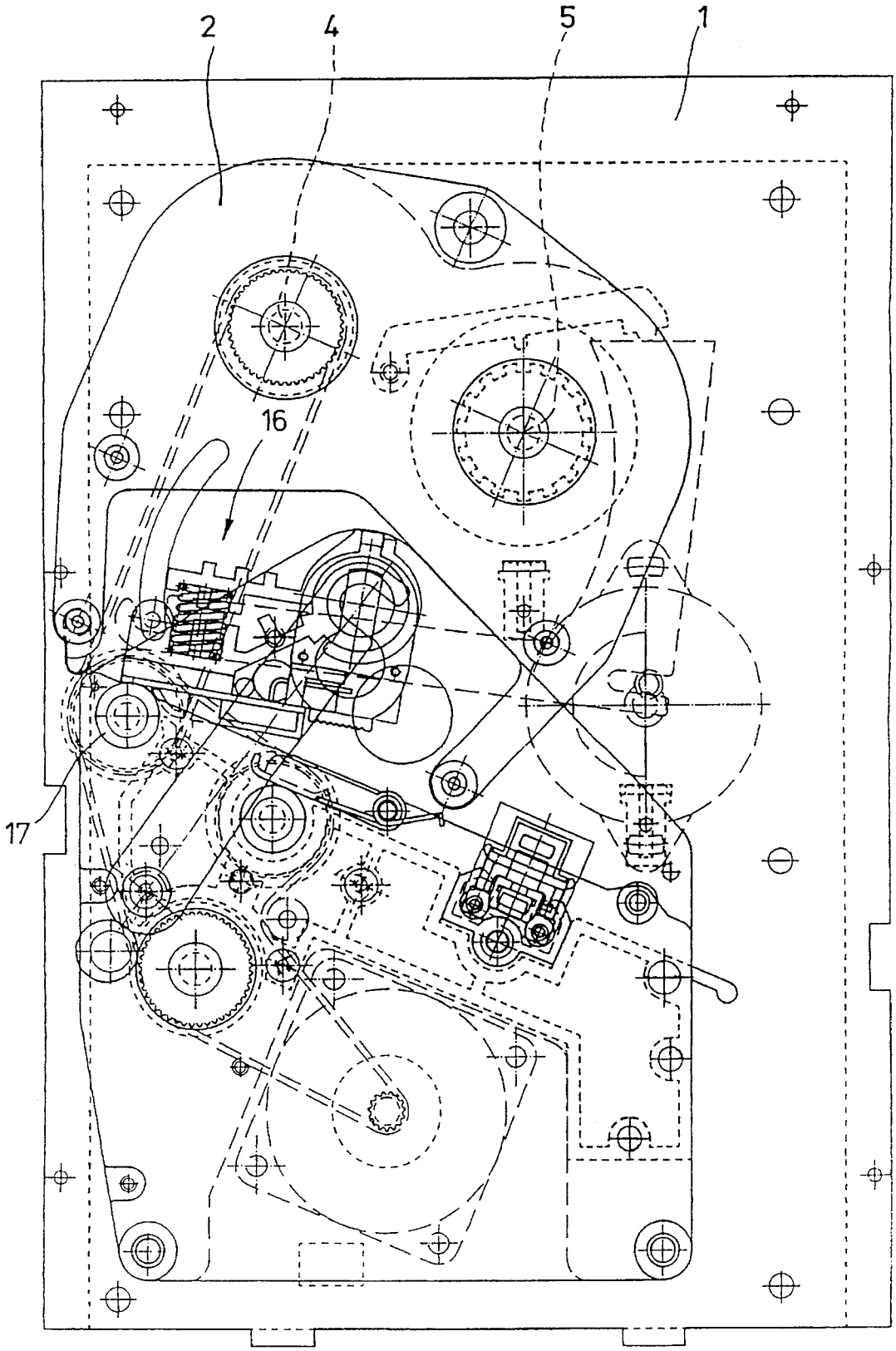
FIG. 1 is a side view of a printer with an inserted cassette.

For a label printer, such as the printer depicted in FIG. 1, a cassette 2 can be inserted into the printer 1 approximately perpendicular to the plane of the drawing. A rear wall 3 (see FIG. 6) of the printer I can preferably be penetrated by two externally-toothed shafts located at a lateral distance from one another, whereby for example the one shaft 4 can be connected to a drive motor, while the other shaft 5 can be a brake shaft connected to a slip clutch. The lateral distance 6 (see FIG. 2) between the two shafts 4 and 5 can preferably correspond to the distance between the holes of the cassette 2, or the distance between the shafts 4 and 5.

Figure 2:
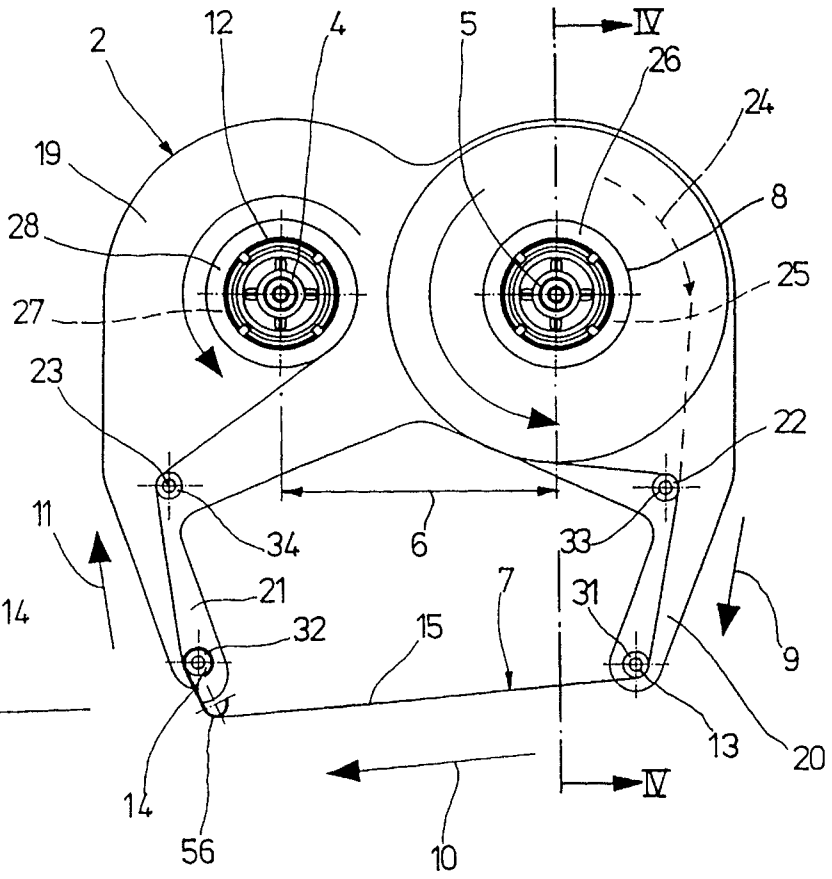
FIG. 2 is a plan view of a somewhat-modified cassette.
Figure 4:
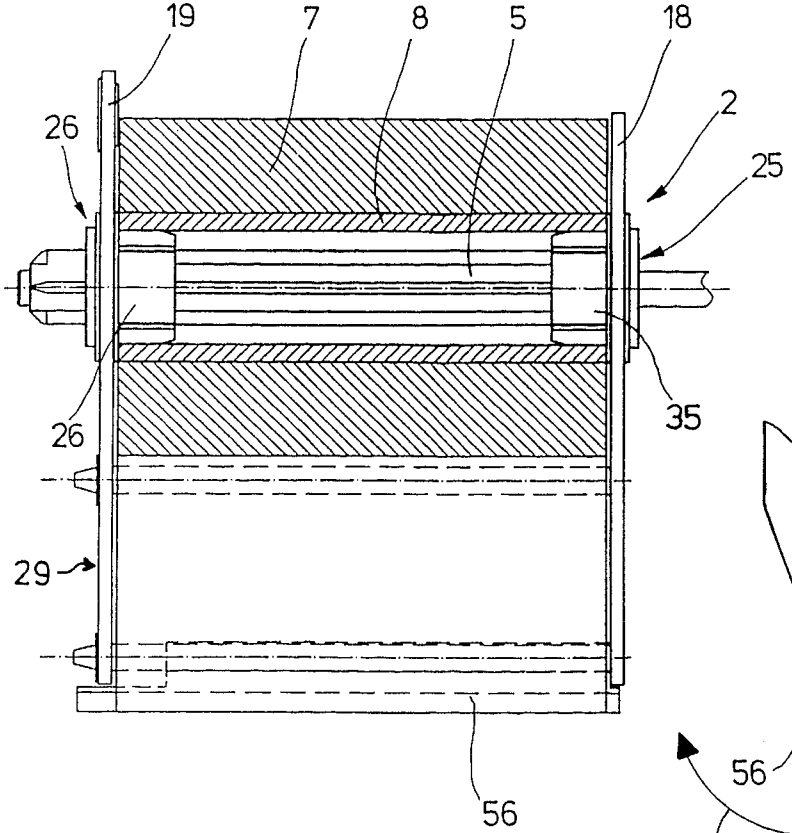
FIG. 4 is a cross section along Line IV—IV in FIG. 2.

As shown in FIGS. 2 and 4, the cassette 2 preferably holds a tape 7 which can preferably be on a core 8, preferably a core made of cardboard, while other materials are usable as well. When this tape 7 is to be paid out in the direction indicated by the arrows 9, 10 and 11 in FIG. 2, the tape 7 and the core 8 are first assigned to the brake shaft 5. When the drive shaft 4 is driven, the ribbon 7 can be unwound from the core 8 and wound up on another core 12, which core 12 can preferably be penetrated by the drive shaft 4. The ribbon 7 can also be deflected by means of deflectors 13 and 14 on the lower end of the cassette in FIG. 2. The segment of the ribbon 7 located between these deflector elements 13 and 14 can preferably form the working, usable strand 15 of the ribbon 7. This working strand 15 can preferably be guided between a printing head 16 of the printer 1 and a printing roller 17 (FIG. 1).

The essential components of the cassette 2 can essentially be two parallel housing halves 18 and 19 as shown in FIG. 4.

Figure 7:
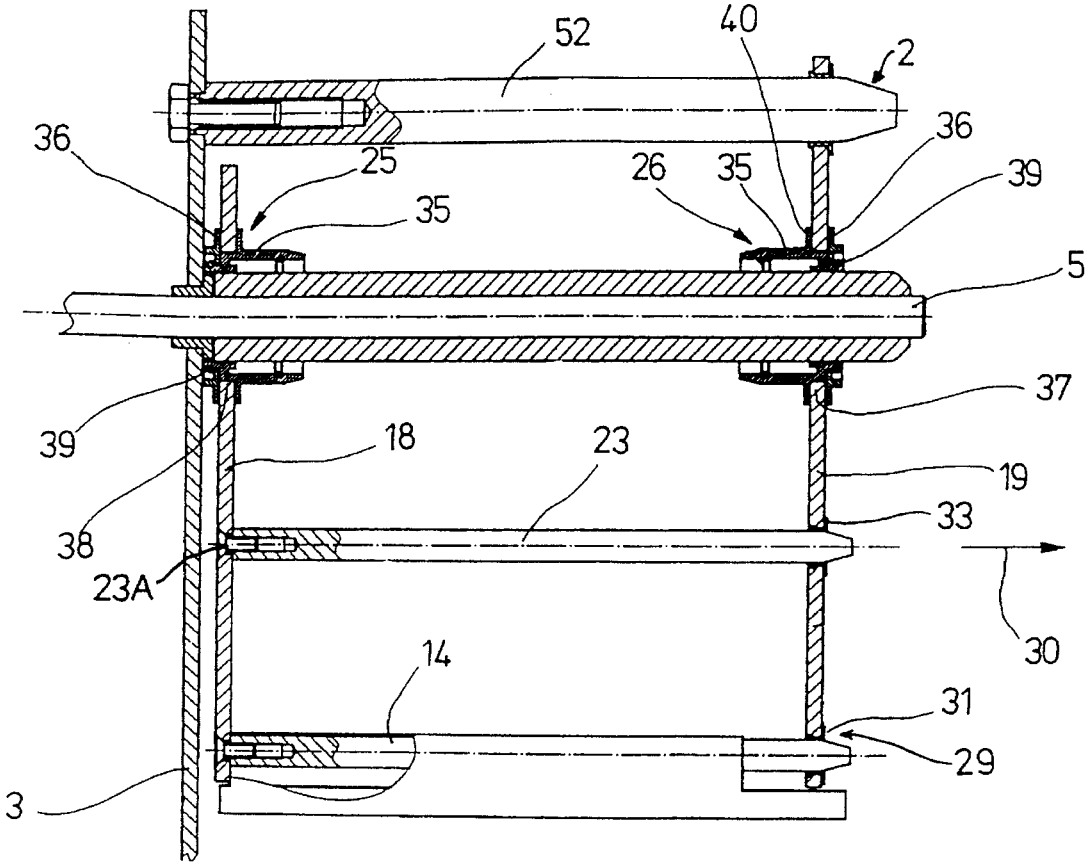
FIG. 7 is a cross section through the cassette illustrated in FIG. 2, whereby the cross section is as illustrated in FIG. 5.

The housing halves 18 and 19 can essentially be C-shaped, as shown in FIG. 2, so that cassette arms 20 and 21 are formed. The two deflector elements 13 and 14, which can preferably be pins, pointed on the free end thereof, as illustrated in FIG. 7, for example, can preferably be attached to the free ends of the arms.

Approximately at the transition to each arm 20 and 21, there can preferably be respective additional deflector elements 22 and 23 for the ribbon 7. Also as illustrated in FIG. 7, the deflector elements 22 and 23 can preferably be pointed pins which can be fastened to the housing half 18 by means of a screw 23A, i.e. preferably to the housing half which corresponds to the rear wall 3. The ribbon 7 can either be unwound as shown by the solid line 24*a* in FIG. 2, or, alternatively, can be unwound as shown by the dotted line 24 in FIG. 2. As such, the cassette 2 can be used both for an externally-wound ribbon or tape 7 and for an internally wound ribbon.

Additional important elements of the cassette 2 include at least one core on each shaft 4 and 5, respectively. But in all the embodiments, instead of one long core on each shaft 4 and 5, there can alternatively be, two short, coaxial cores 25 and 26 or 27 and 28 respectively, as shown in FIGS. 2 and 4. Each pair of cores 25, 26 and 27, 28 can hold the ends of a tape core 8 or 12 respectively. The cores 25 and 27 can be mounted so that they can rotate in the first housing half 18, and the cores 26 and 28 so that they can rotate in the second housing half 19. Each core 25 to 28 can be designed in two parts as illustrated in FIG. 7, for example, which facilitates the installation of the cores in the housing 29. This housing 29, as described above, can be formed from the two housing halves 18 and 19 and the deflector elements 13, 14, 22 and 23, preferably formed by pins.

Figure 5:
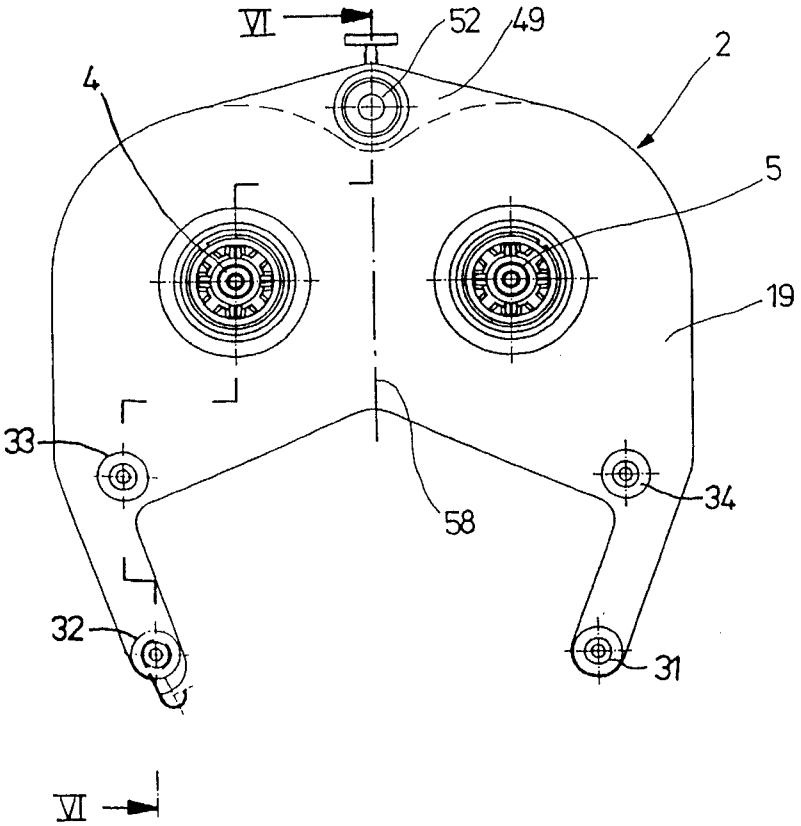
FIG. 5 is a plan view of the cassette illustrated in FIG. 1.

The housing half 19 can be pulled off the pins 13, 14, 22 and 23 (shown in FIG. 2) in the direction of the arrow 30 (shown in FIG. 7), and can preferably be held on the free ends of the pins essentially only by clamping. The deflector elements 13, 14, 22 and 23 can provide for a correct positioning of the housing half 19, and can each be preferably held by a bushing, preferably a plastic bushing 31, 32, 33 and 34 as shown in FIG. 2 and 5, in each opening of the second housing half 19.

In an alternative embodiment of the apparatus, the bushings 31–34 could be optional if the surfaces of the pins 13, 14, 22 and 23 or of the adjoining orifices through which the pins pass, had a surface treatment which performed in the same manner as the bushing 31–34. For example, a plastic coating could be applied to form a wear layer with an appropriate friction coefficient that inhibited movement of the housing half 19 along the pins 13, 14, 22 and 23. In addition, it could also be possible in further embodiments of the invention to make the pins 13, 14, 22 and 23, or even the second housing half 19, completely from such a plastic material. Alternatively, it would also be conceivable that the pins or second housing half could be constructed entirely of a metal designed for the purpose of having a higher frictional engagement. Such a metal could include various steel alloys, or metal composites. It is also conceivable that the pins could be constructed essentially entirely of a first metal, and could then have a further metal coating on the exterior thereof, which metal coating could be selected to provide the desired frictional engagement between the pins and the second housing half. In essence, in accordance with the present invention it is desirable that there preferably be a non-mechanical engagement between the pins 13, 14, 22 and 23, and the second housing half 19, so that the housing half can be slidably unencumberdly positioned along the pins, and then remain in position once placed. By not requiring mechanical locking members, the overall structure of the cassette can thereby be simplified.

As shown in FIG. 7, for example, all the cores 25 to 28 can be designed in two pieces, and each of them can be formed by a sleeve-shaped base part 35 and a ring-shaped retaining part 36 which can be connected to the cores. The sleeve-shaped base parts 35 can be inserted in corresponding holes 37 and 38 in the housing halves 19 and 18 respectively. The ring-shaped retaining part 36 can be inserted onto the projecting end, and can be axially secured by means of a retaining element 39, preferably a retaining ring, which retaining element 39 could preferably snap into a groove 41A as shown in FIGS. 9 and 11. Each sleeve-shaped base element 35 can be in contact by means of an external shoulder 40 (see FIGS. 9 and 11) against the inside surface of the corresponding housing half 18 or 19 respectively. Opposite, on the outside of each housing half 18 or 19, the ring-shaped retaining part 36 can preferably axially secure each base element to the housing half 18 or 19 respectively.

FIGS. 9 and 11 show in particular that the base part 35 becomes smaller in a stepped fashion, whereby the ring-shaped retaining part 36 (shown in FIG.7) can be pressed onto the smaller sleeve-shaped partial piece 41, and the retaining element 39 (shown in FIG.7) can be locked to the retaining element 36 via notch 41A. This partial piece 41 can be elongated into the inside of the core, as shown in FIGS. 9 and 11. In any case, on the smaller, sleeve-shaped partial piece 41 of the first cores 26 and 28, there can be internal teeth 42 (see FIGS. 10 and 11) which can correspond to the external teeth 43 on the shafts 4 and 5 respectively, see FIGS. 12 and 13. Such internal teeth could also be provided on all the sleeve-shaped base parts 35, but the embodiments specify that the sleeve-shaped base parts 35 of the second cores 25 and 27 have a hole 44 with a preferably smooth inner surface, as shown in FIGS. 8 and 9. The free ends of the teeth 43 of the shafts 4 and 5 can then be in contact with this smooth inner surface.

FIGS. 9 and 11 also show that the sleeve-shaped base parts 35 can be provided in the vicinity of their larger diameter with slots 45, thereby forming flexible tabs 46. FIGS. 8 and 10 show that the flexible tabs 46, of FIGS. 9 and 11, can each have a radially projecting retaining element 47 on the outside, preferably in the form of a small radial strip. This can improve the frictional and interlocking connection between the cores 25 to 28 and the tape cores 8 and 12 respectively. To maintain the clamping action between the tabs 46 and the tape cores 8 and 12, the tabs 46 can be permanently pushed radially outward by a retaining ring (not shown) which can be inserted in an internal groove 59. As shown in FIGS. 10 and 13, there can be a larger number, e.g. twice the number of locator grooves 48 than the number of teeth 43, i.e. eight grooves 48 as compared to only four teeth 43.

Figure 6:
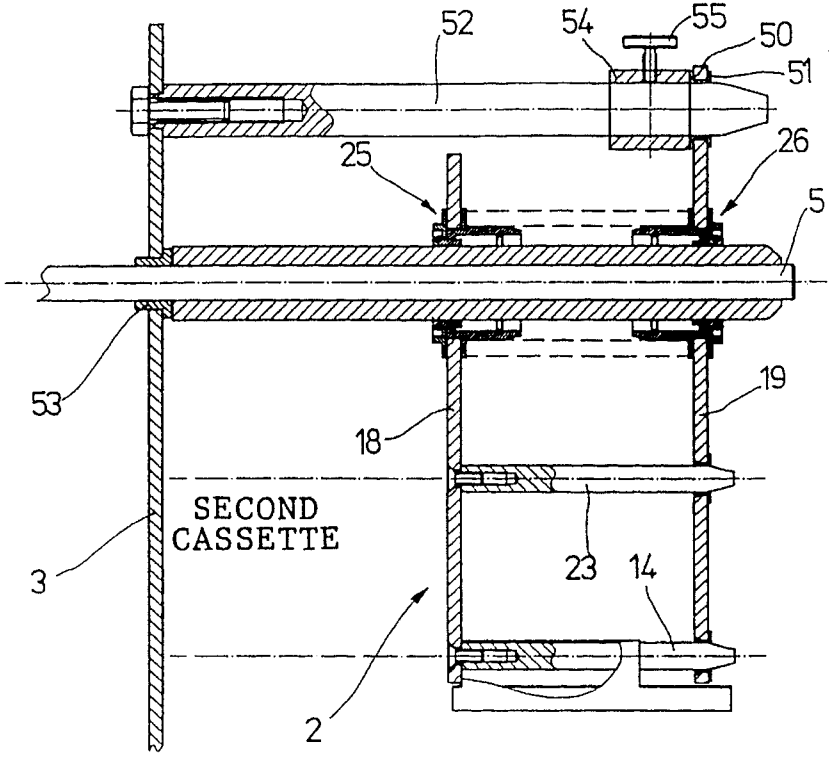
FIG. 6 is a cross section along line VI—VI in FIG. 5.

The cassette 2 illustrated in FIG. 7 is intended for relatively wide tapes 7. But it is also possible to install narrower tapes 7 in this cassette 2, because the second housing half 19 can be mounted so that it can move on the pin-like deflector elements 13, 14, 22 and 23, and can be held in each position by friction. But if the second housing half 19, starting from its position in FIG. 7, is moved to the left toward the first housing half 18, the free ends of the pins on the right project beyond the housing half 19. If this is unacceptable for any reason, or at least if it is undesirable, shorter pins can be used instead. A change-over from long pins to short pins can essentially be performed very easily, because the pins are simply screwed or bolted onto the first housing half 18. FIG. 6 shows one embodiment with short pins or deflector elements 13, 14; 22, 23.

Otherwise, however, this embodiment of FIG. 6, is designed similarly to the cassette 2 illustrated in FIG. 7, with essentially only one slight difference, namely that the shape of the housing half 19 of FIG. 6, on its upper end, differs from the shape of the cassette illustrated in FIG. 2. In the embodiment of FIG. 6, the housing half 19 can be provided on its upper end with a bulge 49 (see FIGS. 5 and 6) in which there is a passage 50. In the latter case, a bearing bushing 51, preferably made of plastic, is inserted. When this cassette is inserted into the printer 1, a locator pin 52 located on the rear wall 3 of the printer 1 can be engaged in the hole of the bearing bushing 51. The cassette 2 illustrated in FIGS. 5 and 6 can be securely fixed in the printer 1 by means of this locator pin 52 and the two shafts 4 and 5. To facilitate the insertion of the cassette 2, the free end of the locator pin 52 can preferably be somewhat pointed. As shown in the accompanying figures, the same can be true of the shafts 4 and 5. The shafts 4 and 5 can also each run through a bearing bush 53 in the wall 3. The bearing bush 53 in the wall 3 is preferably used for the axial and radial support of the shafts.

Because the cassette 2 illustrated in FIG. 6 is narrower than the cassette 2 in FIG. 7, the thickness of which equals approximately the length of the shafts 4 and 5, to the extent that the shafts 4 and 5 project beyond the wall 3, the precise position of the cassette 2 with respect to the printer 1 or its wall 3 must be specified by suitable means. One possibility is to place a sliding collar 54 with a set screw 55 over the locator pin 2. It is easy to see that by pushing the sliding collar 54 toward the left, i.e. toward the wall 3, the stop formed by the sliding collar can be moved, and thus the cassette 2 can be moved back closer to the wall 3. On the other hand, as shown in FIG. 6, it could also be possible to install two cassettes 2 (one of which is shown only schematically) next to one another in the printer 1, whereby each cassette can be loaded with an individual printing ribbon, e.g. with ribbons of different colors.

It is also possible first to print any labels or similar material with the cassette 2 in the position illustrated in FIG. 6, and then to push the cassette 2 all the way to the left, to then apply a second impression next to the first impression on the material being printed.

Figure 3:
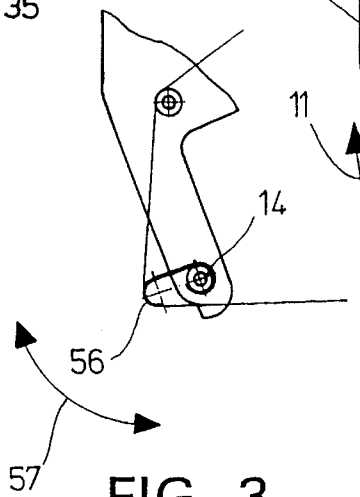
FIG. 3 is a detail of FIG. 2, with the guide plate in another position.

In the vicinity of at least one of the deflector elements 13, 14 in the embodiment illustrated in FIG. 2, and 3 deflector element 14, there can preferably be a guide plate 56 which can be pivotably mounted on this deflector element 13 or 14, so that the guide plate 56 can pivot in the direction shown by the double arrow 57. The guide plate 56 can preferably be clamped in its respective pivot position. The working position of the guide plate 56 is shown in FIG. 2. The usable strand 15 can thereby be pulled out beyond the free end of the cassette arm 21. If, on the other hand, the guide plate 56 were to be moved into the angular position illustrated in FIG. 3, the strand 15 would not project downward beyond the free end of the housing 29, but if necessary, would project laterally beyond the outside of the cassette arm 21. But that is irrelevant when the cassette 2 is installed in the printer 1, in terms of a danger of damage to the ribbon. By pulling the left end of the usable strand 15 out of the cassette 2, as shown in FIG. 2, the printing roller 17 (shown in FIG. 1) could be wrapped over a somewhat greater angle, thereby increasing frictional engagement between the printing roller 17 and the strand 15, which would be advantageous for printing at a high ribbon speed.

Because the cassette 2 is symmetrical along a longitudinal center plane 58 (FIG. 5), it can be used as a reversible cassette, i.e. after the ribbon 7 has run all the way through, the cassette 2 can preferably be simply turned over like known audio cassettes, and the ribbon 7 can be run through once again. For such reversibility, a guide plate 56 could preferably also be required on the cassette arm 20. Either a guide plate 56, as shown in FIG. 2 and 4, can be attached to both cassette arms 20 and 21, or the guide plate 56 can be switched from one cassette arm to the other, so that it can be removed from the cassette arm 21 and pushed onto the cassette arm 20 after the cassette 2 has been turned over.

The cassettes 2 described above can be assembled and disassembled easily. In particular, the cassette 2 can be inserted into the printer 1 easily as a result of the design of the shafts 4 and 5 and the corresponding cores 25 to 28 in a self-locating mechanism, whereby the ease of insertion can be further increased if there are twice the number of locator grooves 48 (shown in FIG.10).

Figure 14:
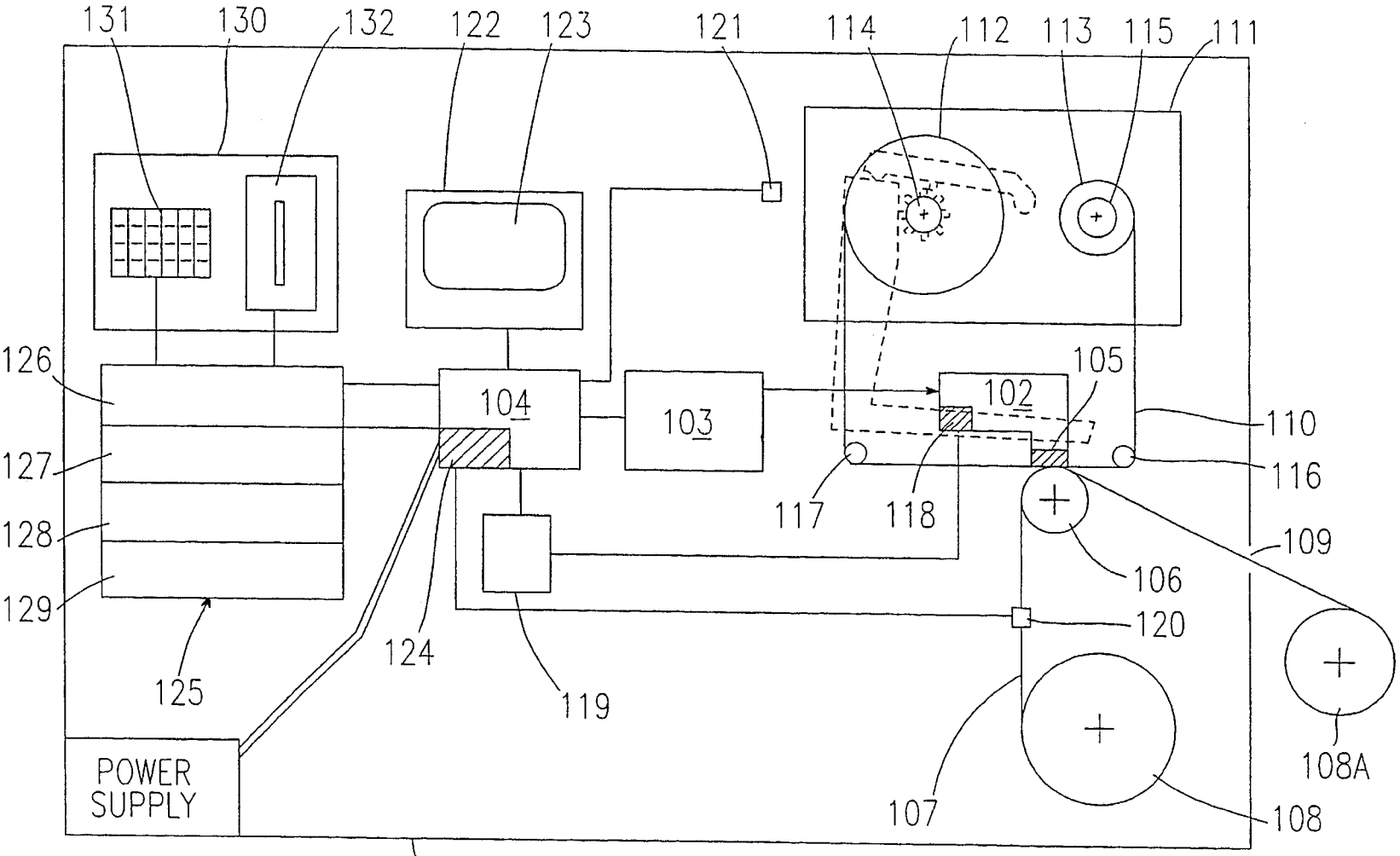
FIG. 14 is a general depiction of the components of a thermal printer.

One type of thermal printer which could utilize a ribbon cassette as discussed above with relation to FIGS. 1–13, is depicted in FIG. 14. The thermal printer 101 has a thermal print head 102 which can be electrically connected by means of a control circuit 103 to a computer processor 104. On the underside of the thermal print head 102 there are preferably electrically activated heating elements 105, which can be maintained in contact against a counterpressure roller 106. Preferably, the heating elements 105 can be oriented in a straight line lying perpendicular to the plane of the drawing and aligned with a longitudinal axis of the counterpressure roller 106.

A label strip 107 can be introduced between the heating elements 105 and the counterpressure roller 106. As the label strip 107 is printed, it is preferably unrolled by means of a label strip payoff reel 108, and can, if desired be taken up by a take-up reel 108A. After having been printed with the desired printing information, the label strip 107 can be output by means of an outlet opening 109 of the thermal printer 101. The above described thermal printer apparatus 101, including the print head 102, the heating elements 105 and the label strips 107, are generally known in the art and are not described in great detail herein.

The label strip 107 can be temperature-sensitive paper which is printed as it is moved past the pin-shaped heating elements 105. Appropriate ones of the heating elements 105 can be heated as necessary, and the areas of the paper, or label strip 107, to which heat is applied can thereby be darkened at the desired points. Alternatively, the label strip 107 can also be conventional writing paper. With such conventional writing paper, it is generally necessary to introduce a thermal transfer ink ribbon 110 between the label strip 107 and the heating elements 105 of the thermal print head 102. The thermal transfer ink ribbon 110 can essentially be coated with temperature sensitive ink, which can preferably be configured to melt at the points where it is moved past activated, or heated, heating elements 105. The melted ink then can adhere to the conventional label strip 107 to thereby form a desired printed image.

Such a thermal transfer ink ribbon 110 can preferably be housed in a cassette 111, which cassette 111 can preferably have a payoff reel 112 and a take-up reel 113 therein. The cassette 111 can generally be positioned within the thermal printer 101 by means of devices 114, 115 which are configured to fit into, or hold the reels 112, 113. The thermal printer 101 can also preferably have deflector rollers 116 and 117 disposed within the printer housing, to direct the path of the ink transfer ribbon past the print head 102 and heating elements 105. Such deflector rollers 116, 117 essentially make certain that the thermal transfer ink ribbon 110 is moved past the heating elements 105 at the optimum angle for transferring the ink to the paper, or label strip 107, in which the ribbon 110 is in contact at the print head 105. Such thermal transfer ink ribbons, and the manner of transferring the ink thereon, are also considered to be well known in the art.

The thermal print head 102 can be equipped with a temperature sensor 118 to transmit an analog electrical signal corresponding to the temperature of the thermal print head 102 to an analog-digital (A-D) converter 119. This A-D converter can then digitize the temperature signal and transmit the digitized signal to the processor 104.

The processor 104 can also preferably be connected to a paper sensor 120, which can be, for example, a photoelectric cell which detects the presence of a label strip 107, and reports the presence or absence of a strip to the processor 104. Alternatively, the paper sensor 120 can also be configured as a laser scanner which is capable of reading bar codes. If such a scanner were to be used, bar code markings, indicative of the type of paper being used, could be provided on the paper strips. The bar code markings on the label strip 107 could then be automatically read by the scanner to provide the processor 104 with information not only about the presence of the label strip material, but also about the type of label strip material present. These data can be retrieved by the processor 104 for further processing.

The processor 104 can also preferably be electrically connected to an ink ribbon sensor 121. This ink ribbon sensor 121 can be designed either as a photoelectric cell, only to detect the presence of the thermal transfer ink ribbon 110, or, as discussed above for the paper sensor, can be designed as a laser scanner which can read the bar codes applied to the cassette 111, to thereby provide information on the material, or type of thermal transfer ink ribbon 110 being used. Photoelectric cells and laser scanners are essentially well known, and are therefore not described in any further detail herein.

Other types of sensors or scanners, within the skill of the artisan could also be used for detecting the paper or ink ribbon, or alternately scanning information provided on the paper or ink ribbon.

In order to make the thermal printer more "user-friendly", the processor 104 can preferably be connected to an optical data output medium 122. Such an output device 122 could provide an LCD screen 123 for displaying variables which the operator may have to adjust, or to alternately display control commands for operation of the printer. Various alternative output devices would also be within the skill of the artisan.

The processor 104 can also preferably be equipped with a working memory 124, the capacity of which is preferably sufficient to buffer the control data supplied both by a read/write memory 125 connected to the processor 104, and also by the paper sensor 120 and by the ink ribbon sensor 121 during a printing process. The processor 104 can preferably use this information to control the label printer 101. With such a buffer, or working memory 124, the processor could essentially operate at higher speeds as data transfer between the read/write memory 125 and the processor 104 would not need to continuously take place.

The read/write memory 125 can essentially be partitioned into several areas depending on the features of the thermal printer. The example shown in FIG. 14 essentially depicts four memory areas 126 to 129, but more or less could be provided, with the possibility for future expansion as needed. The memory areas could be set up as provided below, but the following is meant as an example only, and various other set-ups would be well within the skill of the artisan.

A first memory area 126, could be used to store the information which is to be applied, or printed on the labels. A second memory area 127 could be used to store a data matrix corresponding to the various types of paper which are usable for the label strips 107. A third memory 128 could be used to store the printing speed, that can be set or selected by the operator, and a fourth memory area 129 could be used to store the ink ribbon data corresponding to the various types of paper of the specified label strip 107.

The number of data matrices stored in the second memory area 127 should preferably correspond to the number of types of paper of the label strips 107 which are specified for use on the particular printer. Each of these data matrices is indicative of the type of paper it describes, and can, for example, be an array of three rows of data, whereby the data in the first row could indicate the thermal print head temperatures, the data in the second row could indicate the printing speeds, and the data in the third row could indicate reference energy values. During printing, these reference energy values can be transmitted by the processor 104 preferably directly to the control circuit 103 to control the thermal energies to be generated by the thermal print head 102 in each of the individual heating elements 105 to thereby produce an optimized print. For each data pair consisting of a thermal print head temperature and a printing speed, there is preferably a corresponding reference energy value for the paper being printed upon. Thus, when a temperature and a speed value are input, a reference energy value can clearly be determined and output.

The ink ribbon data contained in the fourth memory area 129 could essentially be described as a list consisting of three rows. The data in the first row could indicate the type of paper of the label strip 107 to be used. The data in the second row could have the values 0 and 1, whereby a "0" can mean that when the type of paper listed in the first row is being used for printing, no thermal transfer ink ribbon is necessary, and a "1" could indicate that an ink ribbon is necessary for printing. In the third row, there can either be a "0" which can indicate that when a particular type of paper is used, no special requirements need to be set for the material of the thermal transfer ink ribbon 10, or another digit, i.e., 1, 2, 3, etc. could indicate which type of ink ribbon must be used to print the specific type of paper.

The above described data arrays can preferably be read into the read/write memory 125 by means of a data input device 130. Such an input device 130 could essentially be a computer keyboard 131 and a card reader device 132, or in essence could essentially be any type of input mechanism which are commonly used for entering data values into computers, i.e. a scanner.

During the installation of the thermal printer, the data matrices corresponding to the types of paper to be used can be read into the corresponding memory area, or in this example, the second memory area 127. Likewise, the ink ribbon data can be read into its corresponding memory area, or the fourth memory area 129 of the read/write memory 125. Then, when printing is to be done, the data to be printed on the label strip 107 can be input into its corresponding memory area, or the first memory area 126 by means of the input device 130, or computer keyboard 131 and the card reader 132.

The processor 104, via the LCD screen 123, can then preferably output a list of the types of paper that were read into the second memory area 127. The operator can then manually select the data matrix corresponding to the type of paper to be used. Further, the printer may also be set up so that the operator is given an opportunity to verify whether there is a data matrix already stored for the particular type of paper of the label strip 107. Thus, if necessary, the appropriate data matrix can then be read into the corresponding memory area, or second memory area 127 of the read/write memory 125. Alternatively, a label strip 107 of a paper with a data matrix already stored in the memory and displayed on the LCD screen 123 can be introduced into the thermal printer 101.

The processor 104 can then retrieve the data matrix corresponding to the type of paper selected, and can call up the corresponding ink ribbon data from the read/write memory 125, and store these data in its working memory 124.

By means of the LCD screen 123, the processor 104 can output a list of the possible printing speeds contained in the data matrix, and thus enable the operator to select a desired printing speed. If the operator does not select a speed, the processor can automatically default to a predetermined printer speed, which can be, for example, the maximum possible printing speed of the printer. Alternately, if it is known that operation at the maximum speed is not desired, alternative default speeds, such as 50% or 75% of the maximum speed could be entered as the default speed if so desired.

The above described thermal printer 101, thereby provides an opportunity at the beginning of the printing process to select a printing speed, which printing speed can then be stored in the third memory area 128 of the read/write memory 125. After the selected data matrix has been read into the working memory 124, the processor 104 can preferably retrieve the value corresponding to the desired printing speed from the third memory area 128, and compare this value to the speed values contained in the data matrix. The processor 104 can then preferably automatically select the value from the data matrix which either corresponds to, or is closest to the selected printing speed.

By means of the temperature sensor 118, the processor 104 can measure the temperature of the thermal print head 102 and then select, from the data matrix, the temperature value corresponding to, or closest to this value.

From the data matrix, and using the above-chosen temperature and speed values, the processor 104 can then preferably select the reference energy value which is specified for the measured value of the thermal print head temperature and the selected or specified printing speed.

In addition to the above-determinations, the processor can also proceed with determining whether or not an ink ribbon is needed, or what type of ribbon is needed. On the basis of the ink ribbon data read into the working memory 124 and specific to the type of paper, and on the basis of the data supplied by the ink ribbon sensor 121, the processor 104 can then check for the following conditions:

A) whether there is a "1" in the second row of the ink ribbon data (indicating that an ink ribbon is needed), and whether a cassette 111 for the thermal transfer ink ribbon 110 has been inserted; or B) whether there is a "0" in this position and no cassette 111 has been inserted.

If the requirements indicated above are not fulfilled, the processor can be set up to indicate such to the operator by means of an error message, either a visible, or audible warning. The error message could also contain information as to how to correct the problem, for example, either to remove the wrong cassette 111 which has been inserted, or to insert the missing cassette 111.

The processor 104 can also check to see whether there is a "0" in the third row of the ink ribbon data list, or possibly another digit identifying a thermal transfer ink ribbon 110. On the basis of this value and the values supplied by the ink ribbon sensor 121, the processor 104 can check, if necessary, to see whether the correct thermal transfer ink ribbon 110 has been inserted. By means of an error message displayed on the LCD screen 123, or possibly by an audible warning, the operator can preferably be requested to insert the correct thermal transfer ink ribbon 110 into the printer, if necessary.

Also, on the basis of the data supplied by the paper sensor 120, the processor 104 can preferably check to see whether a label strip 107 has been inserted. A warning signal can also be generated if a paper strip is not present, indicating to the operator that paper needs to be inserted.

The processor 104 can then retrieve the printing information read into the first memory area 126 of the read/write memory 125, and initiate the printing process. To initiate the printing process, the processor 104 will essentially transmit the printing information, the selected or specified printing speed, and the reference energy value selected from the data matrix to the control circuit 103 of the thermal print head 102. The control circuit 103, by means of electrical connections and driver circuits (not shown, but commonly known in the art), can then drive the counterpressure roller 106 to transport the label strip 107, as well as the thermal transfer ink ribbon 110, preferably by means of electric motors, not shown in the figure. The motor for driving the ink ribbon 110 would preferably be connected to the take-up reel 113. The control circuit 103 can also preferably start the printing process itself by activating the individual heating elements 105 as a function of the input and measured data.

The reference energy value determined from the printing speed and the thermal print head temperature essentially then controls the thermal energy generated by the heating elements 105. The thermal energy generated would preferably be greater, the higher the printing speed set, and the lower the measured thermal print head temperature. Preferably, the thermal energy can be controlled by changing the times at which a specified voltage is applied to the heating elements 105. Such heating elements 105 are preferably designed as resistance heating elements.

If the paper sensor 120 is configured as a laser scanner capable of reading bar codes, and if markings are applied to the labels in the form of bar codes which provide information on the type of paper used for the labels, the operation of the thermal printer 101 can essentially be automated because the type of paper for the labels need no longer be input manually by the operator, but the processor 104, by means of the paper sensor 120, can automatically identify which type of labels have been inserted. On the basis of the data received in this manner, the processor 104 retrieves the corresponding data matrix from the second memory area 127 of the read/write memory 125, and the ink ribbon data specified for the type of paper identified from the fourth memory area 129. Using these data, the thermal printer 101 can be controlled by the processor 104 as described above.

Figure 16:
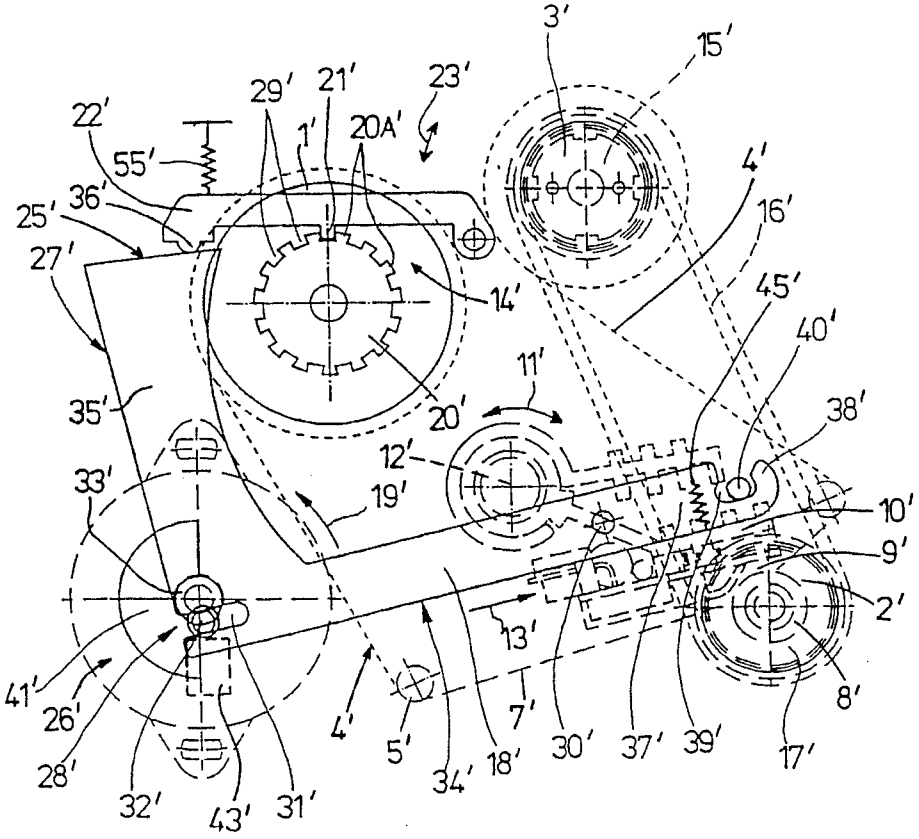
FIGS. 15 and 16 further illustrate additional components of a printer which can be used in conjunction with an inking ribbon cassette.
Figure 15:
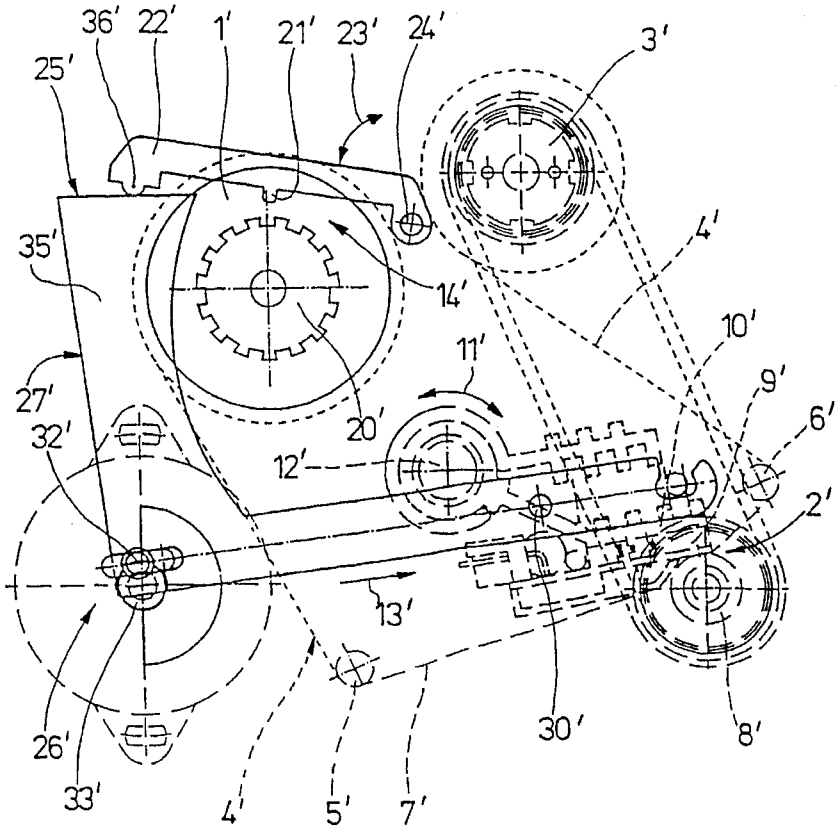

In a printer for printing labels, there can typically be a printing area 2' as shown in FIGS. 15 and 16. For the following, FIGS. 15 and 16 should essentially be considered together and reference numbers which refer to one could also refer to the other. In such a printer, an ink ribbon, or thermal transfer ribbon 4' can be unwound from a first spool 1', can be guided through the printing area 2', and can then be wound up on a second spool 3' which could alternately be termed a "take-up spool". The two spools 1' and 3', are preferably located in an ink ribbon cassette, as discussed above. In addition to the spools 1' and 3', guide rollers 5' and 6' can also preferably be a part of the ink ribbon cassette.

A portion of the thermal transfer ribbon 4' which extends between the guide rollers 5' and 6' can essentially be termed an active strand 7' of the ribbon 4'. In the depicted embodiment, this active strand 7' is preferably guided by means of a counterpressure roller 8' on the printer. Between the thermal transfer ribbon 4' and the counterpressure roller 8', a medium to be printed can preferably be guided. Such a printing medium can, for example, include a backing strip which carries labels to be printed. During printing, a thermal print head 9' would typically be disposed in contact with the moving, working strand 7' of the thermal transfer ribbon 4' and, with the interposition of the above-mentioned medium to be printed, presses the thermal transfer ribbon 4' and printing medium firmly against the counterpressure roller 8'.

The application force for pressing the thermal transfer ribbon 4' and printing medium firmly against the counterpressure roller 8' can be applied by a biasing device, such as, for example, a coil compression spring 45', which is shown in FIG. 16. This coil compression spring 45' preferably pushes on a pivoting arm 10'. The pivoting arm 10' supports the thermal print head 9'. The above-mentioned arm 10', which is pushed down by the coil compression spring 45', can pivot around the axis 12' in the direction indicated by the double arrow 11'.

The medium to be printed can also be unwound from a roll or spool and can be wound up, if necessary, on another roll or spool. The medium to be printed can typically be divided into individual fields to be printed, or the medium can also contain labels, for example, which do not need to be printed all the way to their front and rear edges. To this extent, therefore, there can typically be spaces which remain unprinted between succeeding, identical printed segments in the direction of transport 13' of the ribbon and of the medium being printed.

In the unprinted sections of the medium being printed, that is, when no printing is being done, a continual advancement of the thermal transfer ribbon 4' would represent an unjustified expense. In other words, with a continual advancement of the thermal transfer ribbon 4' during periods when no printing is being performed, there would typically be portions of the thermal transfer ribbon 4' which would not have therefore been used, thus resulting in wasted ribbon 4'. The present invention teaches that unnecessary consumption of the thermal transfer ribbon 4' can be reduced, or even possibly eliminated, by stopping advance of the thermal transfer ribbon 4' whenever the medium to be printed, which is in constant motion, does not need to be printed at a given point.

The present invention teaches that this comparatively sudden stopping of the thermal transfer ribbon 4' after printing the "last line" can preferably be accomplished by means of a stopping device 14'. In general, to print in a thermal transfer process, the printer basically requires a corresponding electronic control system with a computer. Because such a control system would essentially already have access to all the necessary data regarding the stopping and starting of printing, the existing control system can preferably also be used to control the stopping device 14'. In other words, the existing control system could preferably be used to move the stopping device 14' into the operating position when the thermal transfer ribbon 4' need not advance, and to release the stopping device 14' once again when the medium to be printed has advanced to the point where the next area to be printed has arrived in the printing area 2'.

The stopping device 14' can preferably also operate in conjunction with a slip clutch 15', which is not illustrated or explained in any further detail herein, as slip clutches are generally well known. In the illustrated embodiment of FIG. 16, the driving side of the slip clutch 15' is driven by means of an endless drive element 16', e.g. a toothed belt, and by an electric motor 17'. Because of the presence of the slip clutch, during a printing job, the electric motor 17' can essentially always remain turned on, so that the driving side of the slip clutch 15' is in constant rotation. The slip clutch 15' transmits the torque from its driving side to its driven side, on which the second spool 3' would generally be located. If the stopping device 14' however or some other cause, such as jamming, were to abruptly interrupt the movement of the ribbon 4', the friction moment of the slip clutch 15' would essentially no longer suffice to transmit the driving force of the electric motor 17' to the driven side of the slip clutch 15', and the slip clutch 15' would consequently slip. Then, as soon as the stopping device 14', once again releases the first spool 1', the driven side of the slip clutch 15' could also move, and consequently the thermal transfer ribbon 4', unwound from the first spool 1', could be wound up again on the second spool 3'.

For various reasons, one of which is to at least prevent a tearing of the thermal transfer ribbon 4' when it is stationary, during these stationary phases, the application pressure with which the thermal print head 9' is pressed against the counterpressure roller 8' should also preferably be overcome. This can be done in a simple manner, e.g. by pivoting an actuation element 18' at the appropriate time, in the direction indicated by the arrow 19', under the control of the printer control system. The actuation element 18' can be connected in a manner not shown in any further detail to the pivoting arm 10', and consequently can drive the arm 10' in the same direction of rotation, whereupon the thermal print head 9' can be raised from the counterpressure roller 8'.

In purely theoretical terms, of course, the counterpressure roller 8' could also be lowered away from the print head 9', but the first alternative is preferable for a variety of reasons. As discussed earlier, since the print head 9' is biased towards the counterpressure roller 8', a movement of the print head 9' against the biasing force would immediately neutralize the biasing force, while a movement of the counterpressure roller 8' away from the print head 9' would only gradually decrease the application force over a distance. On the other hand, if the counterpressure roller 8' was being biased into engagement with the print head 9', a preferred movement of the counterpressure roller might be desirable.

To provide a locking device in accordance with the present invention, the first spool 1' can preferably be non-rotationally connected to an externally-toothed wheel 20'. Above the wheel 20', in the plane of the depicted embodiment, a locking tooth 21' can be provided for engaging with the teeth 20A'of the toothed wheel 20'. The locking tooth 21'can be held by a pivoting arm 22'and can preferably be manufactured as one piece with the pivoting arm 22'. The pivoting arm 22'can preferably be pivoted around an axis 24'in the direction indicated by the double arrow 23', or that is, towards and away from the toothed wheel 20'. During printing, the pivoting arm 22'would typically be in the angular position indicated in FIG. 15, that is, an unengaged position with respect to the toothed wheel 20'. The arm 22'can preferably be retained in this inactive position by means of a holding device, such as a regulatable locking element 25'. By means of a drive mechanism 26', which can preferably be controlled by the control system of the printer, the pivoting arm 22' can be moved into the active position shown in FIG. 16.

In the illustrated embodiment, this movement takes place indirectly, i.e. the locking element 25' is located on a lever 27' which lever 27' is preferably mounted so that it can pivot, and which lever 27' can be adjusted by means of a cam drive mechanism 28' (see FIG. 16), which cam drive mechanism 28' can be moved by the drive mechanism 26'. The lever 27' is preferably an angular lever having legs 34' and 35'. The upper end of leg 35' in the drawing, preferably forms the locking element 25' As soon as this upper end is lowered, the pivoting arm 22' follows this movement, and the locking tooth 21' can thereby be engaged in the next tooth space 29', as shown in FIG. 16. The pivoting arm can preferably follow the downward movement of the lever 27' due to gravity, however, if alternative positioning of the printing arrangement is desired, a biasing device 55' (see FIG. 16) could preferably be provided to bias the arm 22' towards the toothed wheel 20'.

The lever 27' can rotate around an axis 30'. In the vicinity of the angle corner of the lever 27', that is, in the vicinity of the drive 26', there can preferably be an open-edged slot 31' in which a pin 32' can be engaged. Both the slot 31' and the pin 32' are components of a cam drive mechanism 28'. The pin 32' can preferably be attached to a drivable rotational element 33'. This rotational element 33', in accordance with one embodiment of the present invention, can preferably execute only approximately one-half of a revolution to move the pin 32' through an arc of about 180 degrees, and thereby move the lever 27'. Thus, in accordance with the depicted embodiment, to lower the lever 27' from the position shown in FIG. 15 to the position shown in FIG. 16, the rotational element 33' can be rotated 180 degrees in a first direction which could be either a clockwise or counterclockwise direction. Then to move the lever 27' back into its raised position, the rotational element 33' could be moved in a reverse direction 180 degrees. Alternatively, a raising movement could be brought about by a further 180 degree movement in the first direction. Thus, a reversing motor could be used as the drive 26' to provide a clockwise-counterclockwise movement as discussed above. Alternatively, a one-directional motor could be used as the drive 26' to provide only one of: a clockwise movement, or a counterclockwise movement, that is, provided that the slot 31' could accommodate the pin 32' throughout the full circumferential motion of the pin 32'.

The slot 31', as shown in FIG. 16 for example, can preferably extend approximately in the longitudinal direction of the leg 34' of the angular lever 27' hinged to the axis 30'. Consequently, the locking element 25' can preferably be located on the free leg 35'. The pivoting arm 22' with the locking tooth 21', as shown in the illustrated embodiment, can preferably be a simple pivoting lever which has a projection, such as a preferably convex support element 36', on its free end. This support element 36' can preferably be in contact on top with the end surface of the free leg 35' which forms the locking element 25'.

As shown in FIG. 16, the hinged leg 34' of the pivoting angular lever 27' can preferably extend beyond the axis 30'. The extending arm which is thereby formed is designated by 37'. This arm 37' can preferably be hook-shaped on its free end, and the hook 38' can essentially be formed by a slot 39' which can be open on the side A bolt 40' which can be fastened to the pivoting arm 10' can be engaged in this slot 39'. The pivoting arm 10' can in turn preferably be engaged to the print head 9'. It could also be conceivable that a direct connection between the print head 9' and the end 37' of the lever 27' could be provided.

When the rotational element 33' with the pin 32', starting from its angular position illustrated in FIG. 15, is rotated by approximately 180 degrees, e.g. in a counterclockwise direction, the pin 32', which is engaged in the slot 31', can pivot the lever 27' also in the counterclockwise direction around its axis of rotation 30'. As a result, on one hand by means of the connection 39', 40', the thermal print head 9' can be raised from the counterpressure roller 8' and the pressure on the medium to be printed and the thermal transfer ribbon 4' in the printing area 2' can be neutralized. In addition, the locking element 25' can be lowered, whereupon the pivoting arm 22' can execute a pivoting motion in the direction indicated by the arrow 23'. Thus, while the pressure is being released there can be an essentially simultaneous engagement of the locking tooth 21' in a next available tooth space 29', as shown in FIG. 16. The stopping of the thermal printing ribbon 9 is therefore basically accompanied by the elimination of the pressure on the print head 9' in the printing area 2'.

The control for the 180 degree rotational movement of rotational element 33' can preferably be achieved by means of a control cam 41' which can preferably be non-rotationally connected to the rotational element 33' and a sensor 43', e.g. a sensor which could possibly operate on an optical principle, which can preferably sense the two radial edges of the control cam 41'. In this area, therefore, there is a corresponding control unit for the drive motor 26' of the rotational element 33'. In other words, a sensor can preferably be provided for indicating when the cam 41' has attained a 180 degree rotation to thereby stop movement of the cam 41' and the lever 27'.

Alternatively, instead of the cam 41' and drive 26', a solenoid switch could possibly also be used in another possible embodiment of the present invention, to move the lever 27'. As such, a switching of the solenoid between an on and off position could be used to move the lever 27' between the two positions as illustrated in FIGS. 15 and 16. Such solenoid switches are generally well known and are not discussed in any further detail herein.

Figure 17:
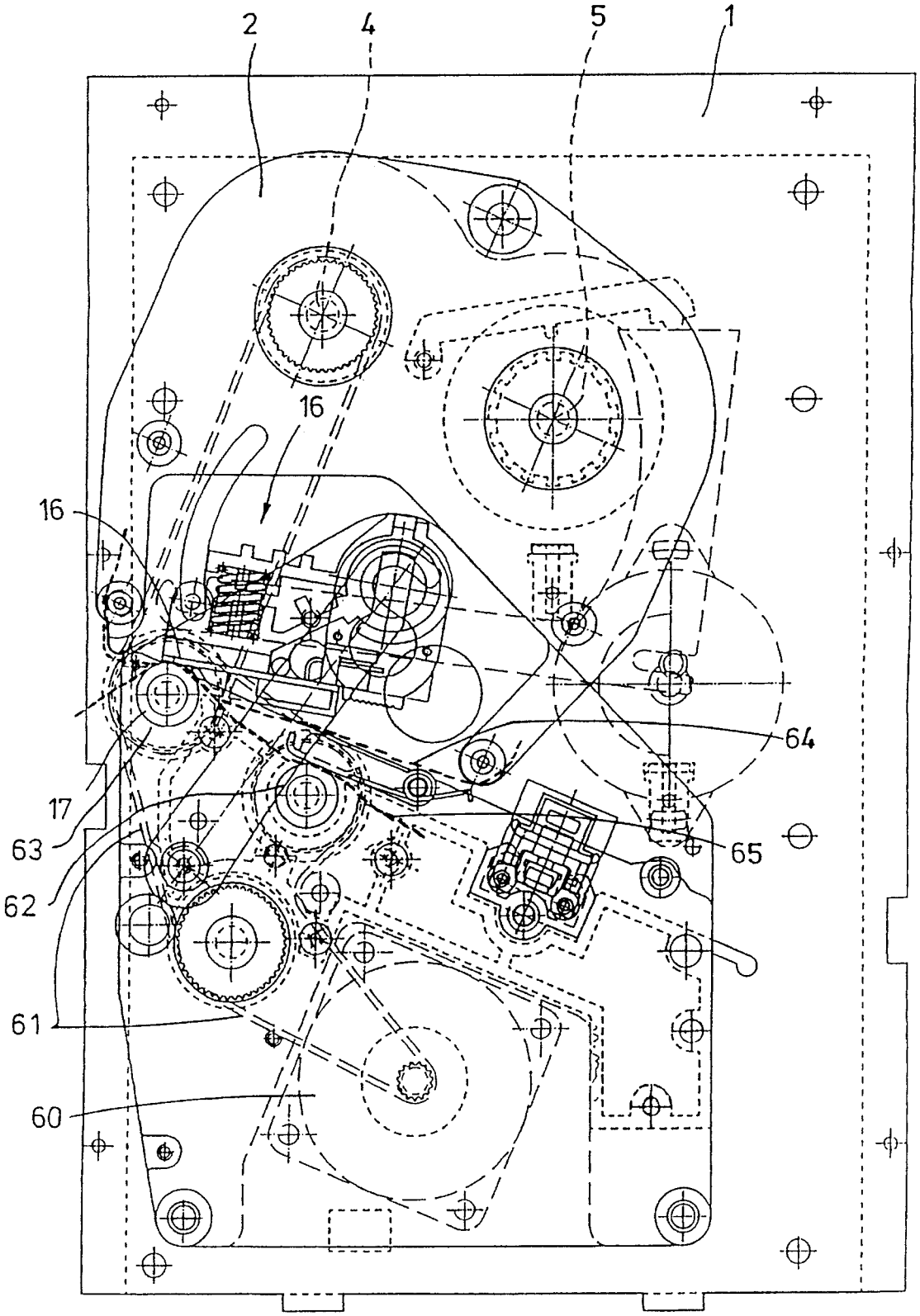
FIG. 17 depicts a further illustration of the area adjacent the print head of a thermal transfer printer.

As depicted in FIG. 17, a drive motor 60 could be provided for feeding the printing ribbon 64 and the label material 65 through the area adjacent the print head 16. In essence, the counter presser roller 17 could be provided to move the label material 65 and printing ribbon 64 past the print head 16 when the counterpressure roller 17 is engaged with the print head 16. However, when the print head 16 is disengaged from the counterpressure roller 17, there would be no further movement of print ribbon 64 or label material 65, and thus, the further roller 62 is also provided to enable a continuous feed of the label material 65. A drive belt 61 could preferably be provided to drive the rollers 17 and 62 by means of pulley devices 63 which can be non-rotatably connected to the rollers 17 and 62.

One feature of the invention resides broadly in the cassette with two internally-toothed cores 25 having parallel geometric axes, which can rotate at some lateral distance from one another in a housing 29 or similar enclosure and each provided with drivers, whereby one of the shafts is a drive shaft 4, and the tape 7 is unwound from the one core 26 and wound up on the other core 28, characterized by the fact that the housing 29 consists essentially of two parallel housing halves 18, 19, which are detachably connected to one another by means of at least two pins retained on the first housing half 18, whereby the geometric axes of the pins run parallel to those of the cores 26, 28, and that the two cores are rotationally mounted on one of the housing halves, e.g. on the second housing half 19, and the at least two pins form deflector elements 13, 14 for the usable strand 15 of the tape 7.

Another feature of the invention resides broadly in the cassette, characterized by the fact that the driver of the shaft 4, 5 has a star-shaped cross section.

Still another feature of the invention resides broadly in the cassette, characterized by the fact that on the first housing half 18 there is a second core 25, 27 for each shaft 4, 5, whereby the tape 7 is always between the two coaxial cores 25, 26; 27, 28 located at some distance from one another.

Yet still another feature of the invention resides broadly in the cassette, characterized by the fact that the second housing half 19 is frictionally held on the pins 13, 14.

Still yet another feature of the invention resides broadly in the cassette, characterized by the fact that on each insertion opening for a,pin 13, 14; 22, 23 there is a bushing retained on the housing half 19, preferably a plastic bushing 31 to 34, e.g. a polyethylene clip-on bearing.

Yet another feature of the invention resides broadly in the cassette, characterized by the fact that both on the tape payout side and on the tape take-up side of the cassette 2, there are two deflector elements 13, 22; 14, 23 located at a distance one behind the other in the direction of travel 9, 11 of the tape.

Still another feature of the invention resides broadly in the cassette, characterized by the fact that all the deflector elements 13, 14, 22, 23 are formed by pins between the two housing halves 18, 19.

Another feature of the invention resides broadly in the cassette, characterized by the fact that all the cores 25 to 28 are designed as two-piece components, and they consist of an inner, essentially-sleeve-shaped base part 35 which at least indirectly holds the corresponding end of the tape, and a ring-shaped retaining part 36 connected or detachably connected to the base part 35 and in contact with the outside of the housing half.

Still another feature of the invention resides broadly in the cassette, characterized by the fact that only one of the core-shaped base parts 35 of the cores 25 to 28 has internal teeth.

Yet another feature of the invention resides broadly in the cassette, characterized by the fact that the core-shaped base parts 35 are provided on their surface with several radially-projecting retaining elements 47, preferably uniformly distributed over the circumference, in particular buttons, webs or similar structures, which can be placed in a frictional or interlocking connection with an elastically flexible tape core 8, 12 preferably made of cardboard, which holds the tape 7.

Still yet another feature of the invention resides broadly in the cassette, characterized by the fact that each base part 35 of the core 25 to 28 has an external shoulder 40 and the housing half 18 or 19 is located between the external shoulder 40 and the ring-shaped retaining part 36.

Yet still another feature of the invention resides broadly in the cassette, characterized by the fact that the base part 35 is slotted in the longitudinal direction to form individual flexible tabs 46 which extend from its end opposite the external shoulder 40 approximately to the external shoulder.

Another feature of the invention resides broadly in the cassette, characterized by the fact that the base part 35 decreases in size in a stepped fashion in the vicinity of the housing halves 18, 19, and the internal teeth are located on the smaller, sleeve-shaped partial piece 41.

Still another feature of the invention resides broadly in the cassette, characterized by the fact that the ring-shaped retaining part 36 is pushed onto the end of the base part 35 which projects beyond the housing half 18 or 19, and is axially secured by means of a retaining element 39, in particular a retaining ring.

Yet still another feature of the invention resides broadly in the cassette, characterized by the fact that on at least one of the housing halves 18, 19, preferably the second housing half 19, there is a hole 50 for the insertion of a locator pin 52 of the machine, in particular a printer 1 into which the cassette 2 is to be inserted.

Still yet another feature of the invention resides broadly in the cassette, characterized by the fact that the second housing half 19 can be placed in contact on the locator pin 52 of the machine 1 with a sliding collar 54 which can be moved and fixed in place.

Another feature of the invention resides broadly in the cassette, characterized by the fact that the hole is formed by the hole of a bearing bushing 51, preferably a plastic bearing bushing, inserted in a hole 50 in the housing half 19.

Still another feature of the invention resides broadly in the cassette, characterized by the fact that the hole 50 is located on a transverse symmetry plane 58 of the cassette 2, and is on the upper end 49 of the cassette, while the deflector elements 13, 14; 22, 23 are located on the lower end of the cassette.

Yet still another feature of the invention resides broadly in the cassette, characterized by the fact that the deflector elements 13, 14 are each located on the free end of a cassette arm 20, 21.

Still yet another feature of the invention resides broadly in the cassette, characterized by the fact that in the vicinity of at least one of the deflector elements 13, 14 there is a guide plate for the tape 7, which projects forward beyond the housing 29.

Yet still another feature of the invention resides broadly in the cassette, characterized by the fact that each guide plate 26 is mounted so that it can pivot on the housing 29, in particular on the corresponding pin-shaped deflector element 13, 14, and in a retracted position, if necessary, projects laterally beyond the housing 29.

Another feature of the invention resides broadly in the cassette, characterized by the fact that on a reversible cassette, a guide plate 55 is or can be attached to each deflector element 13, 14.

Still another feature of the invention resides broadly in the cassette, characterized by the fact that the guide plate can be detachably fastened to the opposite deflector element 13 or 14.

Yet still another feature of the invention resides broadly in the cassette, characterized by the fact that the cassette can be loaded by the user with an unused printing ribbon 7.

Some types of printers and the various components thereof which could be used in conjunction with the present invention are disclosed by the following U.S. Pat. Nos.: 5,160,943 to Pettigrew et al., entitled "Printing Systems"; 5,055,858 to Koch, entitled "Thermal Print Head"; 5,023,628 to Koch, entitled "Thermal Head Mounting/Positioning Assembly"; 5,165,806 to Collins, entitled "Thermal Printer with Movable Drive Roll"; 4,326,813 to Lomicka and Heller, entitled "Dot Matrix Character Printer Control Circuitry for Variable Pitch Printing"; and 4,214,836 to Wang, entitled "Impact Print Head".

Some types of ribbon cassettes, and components thereof which could be used in conjunction with the present invention are disclosed by the following U.S. Pat. Nos. : 5,073,052 to Daley et al., entitled "Reuseable Ink Ribbon Cassette Adjustable To Different Ribbon Widths and Method of Use"; 4,998,834 to Taylor; 4,990,008 to Hwang; 4,974,977 to Morgan et al.; 4,971,462 to Mueller et al.; and 4,776,714 to Sugiura et al.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if any, described herein.

All of the patents, patent applications and publications recited herein and the references cited in any of the documents cited herein, and in the Declaration attached hereto, are hereby incorporated by reference as if set forth in their entirety herein.

The corresponding foreign patent publication applications, namely, Federal Republic of Germany Patent Application No. P 43 32 608.8, having inventor Dirk Umbach, and DE-OS P 43 32 608.8 and DE-PS P 43 32 608.8, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A reusable ribbon cassette for a printer for printing labels on a label material, the cassette being capable of accommodating ribbons having different widths, the printer being configured for transferring a printing substance from a printing ribbon to the label material, the printer comprising: means for storing label material to be printed upon; means for storing printing ribbon, the printing ribbon comprising a printing substance thereon; at least one printing element for printing on the label material, the at least one printing element comprising means for transferring the printing substance from the printing ribbon to the label material; means for actuating the at least one printing element to transfer printing substance from said printing ribbon to the label material to print on the label material; and said means for storing printing ribbon comprising said reusable cassette;

said reusable cassette comprising:

a first housing portion;

a second housing portion;

said first and second housing portions comprising means for holding a supply of printing ribbon therebetween;

at least first and second support shaft means, said first and second support shaft means being spaced apart from one another and extending at least between said first and second housing portions for variably positioning said first and second housing portions with respect to one another to accommodate printing ribbons of different widths therebetween;

said first support shaft means having a first end adjacent said first housing portion and a second end, said second end comprising a portion adjacent said second housing portion;

said second support shaft means having a first end adjacent said first housing portion and a second end, said second end comprising a portion adjacent said second housing portion;

at least one of said first housing portion and said second housing portion comprising corresponding openings therein for receiving said first and second support shaft means therethrough for relatively positioning said first and second housing portions with respect to one another;

said first and second support shaft means disposed through said corresponding openings comprise a frictional engagement between said first and second support shaft means and said openings;

said frictional engagement between said first and second support shaft means and said corresponding openings being sufficient for substantially minimizing movement of said first and second housing portions with respect to one another;

said first and second support shaft means each defining a longitudinal axis, and each of said first and second support shaft means comprising a surface facing radially outwardly away from the longitudinal axis, said surface comprising an external surface;

said external surface of each of said first and second support shaft means comprising a substantially smooth, uninterrupted surface extending between said first and second ends thereof;

said at least one of said first housing portion and said second housing portion comprising a radially inwardly disposed surface defining each said opening therein, said radially inwardly disposed surfaces of said openings for being disposed towards said external surface of one of said first and second support shaft means, said radially inwardly disposed surface of each of said openings comprising an internal surface; and at least one of:

said external surfaces of said first and second support shaft means; and said internal surfaces of said openings, comprising means for frictionally engaging the other of:

said internal surfaces of said openings; and said external surfaces of said first and second support shaft means, to provide frictional engagement between said external surfaces of said first and second support shaft means and said internal surfaces of said openings, and said frictional engagement between said external surfaces of said first and second support shaft means and said internal surfaces of said openings solely being sufficient for detachably securing said first housing portion and said second housing portion in a fixed position with respect to one another.

2. The cassette according to claim 1, wherein:

said first end of each of said first and second support shaft means is fixedly attached to said first housing portion;

said second housing portion comprises said openings therethrough;

said second end of each of said first and second support shaft means is disposed through a corresponding one of said openings of said second housing portion; and said means for holding a supply of ribbon comprises bearing means disposed on at least one of said first and second housing portions for rotatably supporting a ribbon supply spool and a ribbon take-up spool between said first and second housing portions when said first housing portion is detachably secured to said second housing portion.

3. The cassette according to claim 2, wherein:

said means for frictionally engaging comprise bushings disposed within said openings of said second housing portion, said bushings being configured for substantially surrounding and frictionally engaging said first and second support shaft means disposed through said openings of said second housing portion;

said bearing means comprise first and second core means extending from and rotatably mounted to said second housing portion, said first and second core means being disposed spaced apart from one another;

said first core means being configured for receiving at least a ribbon supply spool thereon and said second core means being configured for receiving at least a ribbon take-up spool thereon;

said first and second core means each defining a longitudinal axis, said first and second support shaft means each defining a longitudinal axes, and said longitudinal axis of each of said first and second core means being disposed substantially parallel to said longitudinal axis of each of said first and second support shaft means; and said first and second support shaft means respectively comprise first and second guide pins for guiding ribbon from said ribbon supply spool to said ribbon take-up spool.

4. The cassette according to claim 3, wherein:

said first core means comprises a first core part rotatably disposed on said first housing portion and a second core part rotatably disposed on said second housing portion, said first and second core parts being coaxially aligned with one another;

said second core means comprises a third core part rotatably disposed on said first housing portion and a fourth core part rotatably disposed on said second housing portion, said third and fourth core parts being coaxially aligned with one another;

the ribbon supply spool has a core, and the core of the ribbon supply spool is for being disposed in engagement with, and between said first and second core parts;

the take-up spool has a core, and the core of the take-up spool is for being disposed in engagement with, and between said first and second core parts; and said first core part and said second core part are configured for receiving therein a drive shaft of the printer, the drive shaft for rotating said first core means, and said third core part and said fourth core part are configured for receiving therein a take-up shaft of the printer, the take-up shaft for rotating said second core means, the drive shaft and the take-up shaft each having a plurality of teeth, and at least one of said first core part and said second core part, and at least one of said third core part and said fourth core part, comprising teeth for engaging with the teeth of the drive shaft and the take-up shaft.

5. The cassette according to claim 4, wherein:

said first housing portion comprises a first plate and said second housing porion comprises a second plate;

said first and second plates being disposed substantially parallel to one another when detachably secured to one another;

said bushings comprise plastic bushings;

said cassette further comprises two additional ribbon guide pins for guiding the printing ribbon from the ribbon supply spool to the ribbon take-up spool, said two additional guide pins each define a longitudinal axis, said longitudinal axis of each of said two additional guide pins are disposed parallel to said longitudinal axes of said first and second core means and of said first and second support shaft means;

said longitudinal axes of said first and second core means define a first plane;

said longitudinal axes of said first and second support shaft means define a second plane;

said longitudinal axes of said two additional guide pins define a third plane;

said first, second and third planes being disposed parallel to one another with said second plane disposed between said first and third planes;

said first and second plates each comprise first and second arm portions extending therefrom;

said first and second arm portions each having a first end adjacent said first and second plates, and a second end disposed away from said first and second plates;

said two additional guide pins are disposed at said second ends of said first and second arm portions;

said second ends of said first and second arm portions of said second plate comprise additional corresponding orifices, and corresponding bushings disposed within said orifices, for passage of said two additional guide pins therethrough; and said two additional guide pins having a first end for being fixedly attached to said second ends of said first and second arm portions of said first plate, and a second end for being disposed through said corresponding orifices of said second ends of said first and second arm portions.

6. The cassette according to claim 5, wherein:

said two additional guide pins comprise third and fourth guide pins;

said bushings comprise polyethylene;

said first and second plates, and said first, second, third and fourth guide pins comprise metal;

said first and second plate each have a substantially C-shaped configuration extending from said third guide pin to said first guide pin to said first core means to said second core means to said second guide pin to said fourth guide pin;

said first and second arm portions each have a surrounding edge defining said first and second arm portions;

at least one of said third and fourth guide pins comprises a guide plate pivotably disposed therearound, said guide plate having a portion extending from said at least one of said third and fourth guide pins, said extending portion of said guide plate extending beyond the surrounding edge of said arm portion;

said extending portion of said guide plate being configured for increasing wrap of the ribbon around a ribbon drive roller to increase frictional engagement between the ribbon and a ribbon drive roller;

said guide plate is slidably insertable onto said at least one of said third and fourth guide pins;

said first and second housing plates each have a first surface disposed towards the other of said first and second housing plates, and a second surface disposed opposite said first surfaces;

said first and second housing plates each comprise a first hole therethrough for mounting said first core means thereto, and a second hole therethrough for mounting said second core means thereto;

said first, second, third and fourth core parts each comprise first and second core pieces, and retaining means for fastening together said first and second core pieces;

said first core piece comprising a sleeve-shaped portion disposed through said first and second holes of said first and second housing plates;

said sleeve shaped portion comprising a radially outward extending flange for contacting said first surface of said first and second housing plates adjacent said first and second holes thereof;

said second core piece comprises a ring-shaped retaining element for being disposed at said second surface of said first and second housing plates;

said ring-shaped retaining element comprises a radially outward extending flange for contacting said second surface of said first and second housing plates adjacent said first and second holes thereof;

said sleeve-shaped portion extends through said ring-shaped retaining element;

said retaining means comprises a retaining ring for being disposed about said sleeve-shaped portion extending through said ring-shaped retaining element to retain said ring-shaped retaining element on said sleeve-shaped portion;

said sleeve-shaped portions have a first end and a second end, said second end extending through one of said first and second holes of said housing plate, and said first end comprises a first end portion disposed away from said ring-shaped retaining elements;

said first end portion of said sleeve-shaped portions comprising a plurality of radially extending projections for engaging with an interior of the spool of printing ribbon, said projections comprising at least one of: buttons and webs;

said first end portion of said sleeve-shaped portions comprises a plurality of slots extending from said first end thereof to said radially extending flange thereof, to form flexible tabs between said slots;

said second end of said sleeve-shaped portion is stepped radially inwardly;

said teeth of said sleeve-shaped portion being disposed at said radially inwardly stepped portion;

said first end portion of said sleeve-shaped portion has an interior;

said first, second, third and fourth core means further comprise a biasing ring disposed within said interior of said sleeve-shaped portion to bias said tabs radially outwardly to engage said projections of said sleeve shaped portions with the interior of the core of the ribbon spool;

said interior comprising a circumferential groove, and said biasing ring being disposed in said groove;

said second ends of said first, second, third and fourth guide pins are tapered;

at least said second housing plate comprises a guide hole for guiding placement of said cassette into the printer, the guide hole being configured for receiving therein an additional guide pin of the printer, wherein the additional guide pin of the printer, the drive shaft and the take-up shaft are disposed in a triangular configuration;

said cassette defines a plane of symmetry running between said first and second core means;

said guide hole being disposed on said plane of symmetry, in a direction away from said first and second core means and on an opposite side of said first and second core means away from said first, second, third, and fourth guide pins;

said second housing plate comprises a collar adjacent said guide hole, said collar being slidable on the additional guide pin of the printer, said collar comprising means for limiting movement of said cassette along the guide pin for positioning of said cassette within the printer;

said means for limiting movement comprises an adjustable screw for engaging the additional guide pin of the printer to clamp said cassette in place; and said guide hole comprises a further polyethylene bushing.

7. In a printer for printing labels on a label material by transferring a printing substance from a printing ribbon to the label material, the printer comprising at least one print element for transferring the printing substance from the printing ribbon to the label material, and a cassette for accommodating printing ribbons having different widths, said cassette comprising:

a first housing member;

a second housing member;

said first and second housing members together comprising means for accommodating and holding printing ribbon therebetween;

first and second shaft means extending at least between said first and second housing members for variably positioning said first and second housing members with respect to one another, said first and second shaft means being fixedly attached to said first housing member;

said second housing member comprises at least first and second orifices for receiving said first and second shaft means therein;

at least one of:

said first and said second shaft means, and said first and said second orifices, comprising means for frictionally engaging the other of:

said first and said second shaft means, and said first and said second orifices, for relatively positioning said first housing member with respect to said second housing member and for defining a distance between said first and second housing members, the distance corresponding to the width of the printing ribbon; and said first and second orifices having an interior surface, said first and second shaft means having an exterior surface for being disposed towards said interior surface of said first and second orifices, said exterior surfaces of said first and second shaft means and said interior surfaces of said first and second orifices defining a friction therebetween, the friction between said exterior surfaces of said first and second shaft means and said interior surfaces of said first and second orifices providing at least a substantial portion of a force for maintaining said first housing member and said second housing member in a substantially fixed position with respect to one another.

8. The cassette according to claim 7, further including the friction between said external surface of said support shaft means and said internal surface of said orifices providing substantially the sole force for maintaining said first housing member and said second housing member in a substantially fixed position with respect to one another.

9. The cassette according to claim 8, further including:

said first and second support shaft means being spaced apart from one another;

said first and second orifices corresponding to said first and second support shaft means;

said first support shaft means having a first end attached to said first housing member and a second end, said second end comprising a portion for being disposed through said first orifice of said second housing member;

said second support shaft means having a first end attached to said first housing member and a second end, said second end comprising a portion for being disposed through said second orifice of second housing member;

said external surfaces of said first and second support shaft means comprising smooth, uninterrupted surfaces extending between said first and second ends thereof; and the friction between said external surface of said support shaft means and said internal surface of said orifices providing the sole force for maintaining said first housing member and said second housing member together in a substantially fixed position with respect to one another.

10. The cassette according to claim 9, wherein:

said cassette comprises bearing means disposed on at least one of said first and second housing members for rotatably supporting a ribbon supply spool and a ribbon take-up spool between said first and second housing members when said first housing member is detachably secured to said second housing member;

said bearing means comprise first and second core means extending from and rotatably mounted to said second housing member, said first and second core means being disposed spaced apart from one another;

said first core means being configured for receiving at least a ribbon supply spool thereon and said second core means being configured for receiving at least a ribbon take-up spool thereon;

said first and second core means each defining a longitudinal axis, said first and second support shaft means each defining a longitudinal axis, and said longitudinal axis of each of said first and second core means being disposed substantially parallel to said longitudinal axis of each of said first and second support shaft means; and said first and second support shaft means comprise first and second guide pins for defining a ribbon path and guiding ribbon from said ribbon supply spool to said ribbon take-up spool.

11. The cassette according to claim 10, wherein:

said means for frictionally engaging comprise bushings disposed within said first and second orifices of said second housing member, said bushings being configured for substantially surrounding and frictionally engaging said first and second support shaft means disposed through said first and second orifices of said second housing member, said first core means comprises a first core part rotatably disposed on said first housing member and a second core part rotatably disposed on said second housing member, said first and second core parts being coaxially aligned with one another;

said second core means comprises a third core part rotatably disposed on said first housing member and a fourth core part rotatably disposed on said second housing member, said third and fourth core parts being coaxially aligned with one another;

the ribbon supply spool has a core, and the core of the ribbon supply spool is for being disposed in engagement with, and between said first and second core parts; the take-up spool has a core, and the core of the take-up spool is for being disposed in engagement with, and between said first and second core parts; and said first core part and said second core part are configured for receiving therein a drive shaft of the printer, the drive shaft for rotating said first core means, and said third core part and said fourth core part are configured for receiving therein a take-up shaft of the printer, the take-up shaft for rotating said second core means, the drive shaft and the take-up shaft each having a plurality of teeth, and at least one of said first core part and said second core part, and one of said third core part and said fourth core part, comprising teeth for engaging with the teeth of the drive shaft and the take-up shaft.

12. The cassette according to claim 11, wherein:

said first housing member comprises a first plate and said second housing member comprises a second plate;

said first and second plates being disposed substantially parallel to one another when detachably secured to one another;

said bushings comprise plastic bushings;

said cassette further comprises two additional ribbon guide pins for guiding the printing ribbon from the ribbon supply spool to the ribbon take-up spool, said two additional guide pins each define a longitudinal axis, said longitudinal axis of each of said two additional guide pins are disposed parallel to said longitudinal axes of said first and second core means and of said first and second support shaft means;

said longitudinal axes of said first and second core means define a first plane;

said longitudinal axes of said first and second support shaft means define a second plane;

said longitudinal axes of said two additional guide pins define a third plane;

said first, second and third planes being disposed parallel to one another with said second plane disposed between said first and third planes;

said first and second plates each comprise first and second arm portions extending therefrom;

said first and second arm portions each having a first end adjacent said first and second plates, and a second end disposed away from said first and second plates;

said two additional guide pins are disposed at said second ends of said first and second arm portions;

said second ends of said first and second arm portions of said second plate comprise additional corresponding orifices, and corresponding bushings disposed within said orifices, for passage of said two additional guide pins therethrough; and said two additional guide pins having a first end for being fixedly attached to said second ends of said first and second arm portions of said first plate, and a second end for being disposed through said corresponding orifices of said second ends of said first and second arm portions.

13. The cassette according to claim 12, wherein:

said two additional guide pins comprise third and fourth guide pins;

said bushings comprise polyethylene;

said first and second plates, and said first, second, third and fourth guide pins comprise metal;

said first and second plates each have a substantially C-shaped configuration extending from said third guide pin to said first guide pin to said first core means to said second core means to said second guide pin to said fourth guide pin;

said first and second arm portions each have a surrounding edge defining said first and second arm portions;

at least one of said third and fourth guide pins comprises a guide plate pivotably disposed therearound, said guide plate having a portion extending from said at least one of said third and fourth guide pins, said extending portion of said guide plate extending beyond the surrounding edge of said arm portion;

said extending portion of said guide plate being configured for increasing wrap of the ribbon around a ribbon drive roller to increase frictional engagement between the ribbon and a ribbon drive roller;

said guide plate is slidably inserted onto said at least one of said third and fourth guide pins;

said first and second housing plates each have a first surface disposed towards the other of said first and second housing plates, and a second surface disposed opposite said first surface;

said first and second housing plate each comprise a first hole therethrough for mounting said first core means thereto, and a second hole therethrough for mounting said second core means thereto;

said first, second, third and fourth core parts each comprise first and second core pieces, and retaining means for fastening together said first and second core pieces;

said first core piece comprising a sleeve-shaped portion disposed through said first and second holes of said first and second housing plates;

said sleeve shaped portion comprising a radially outward extending flange for contacting said first surface of said first and second housing plates adjacent said first and second holes thereof;

said second core piece comprises a ring-shaped retaining element for being disposed at said second surface of said first and second housing plates;

said ring-shaped retaining element comprises a radially outward extending flange for contacting said second surface of said first and second housing plates adjacent said first and second holes thereof;

said sleeve-shaped portion extends through said ring-shaped retaining element;

said retaining means comprises a retaining ring for being disposed about said sleeve-shaped portion extending through said ring-shaped retaining element to retain said ring-shaped retaining element on said sleeve-shaped portion;

said sleeve-shaped portions have a first end and a second end, said second end extending through one of said first and second holes of said housing plate, and said first end comprises a first end portion disposed away from said ring-shaped retaining elements;

said first end portion of said sleeve-shaped portions comprising a plurality of radially extending projections for engaging with an interior of the spool of printing ribbon, said projections comprising at least one of: buttons and webs;

said first end portion of said sleeve-shape portions comprises a plurality of slots extending from said first end thereof to said radially extending flange thereof, to form flexible tabs between said slots;

said second end of said sleeve-shape portion is stepped radially inwardly;

said teeth of said sleeve-shaped portion being disposed at said radially inwardly stepped portion;

said first end portion of said sleeve-shaped portion has an interior;

said first, second, third and fourth core parts further comprise a biasing ring disposed within said interior of said sleeve-shaped portion to bias said tabs radially outwardly to engage said projections of said sleeve shaped portions with the interior of the core of the ribbon spool;

said interior comprising a circumferential groove, and said biasing ring being disposed in said groove;

said second ends of said first, second, third and fourth guide pins are tapered;

at least said second housing plate comprises a guide hole for guiding placement of said cassette into the printer, the guide hole being configured for receiving therein an additional guide pin of the printer, wherein the additional guide pin, the drive shaft and the take-up shaft are disposed in a triangular configuration;

said cassette defines a plane of symmetry running between said first and second core means;

said guide hole being disposed on said plane of symmetry, in a direction away from said first and second core means and on an opposite side of said first and second core means away from said first, second, third, and fourth guide pins;

said second housing plate comprises a collar adjacent said guide hole, said collar being slidable on the additional guide pin of the printer said collar comprising means for limiting movement of said cassette along the guide pin for positioning of said housing means within the printer;

said means for limiting movement comprises an adjustable screw for engaging the guide pin to clamp said cassette in place; and said guide hole comprises a further polyethylene bushing.

14. A method for using a ribbon cassette to accommodate ink ribbons having different widths, said ribbon cassette comprising first housing portion, a second housing portion, and at least first and second support shaft means extending et least between said first and second housing portions for variably positioning said first and second housing portions with respect to one another; at least said second housing portion comprising means for frictionally engaging said first and second shaft means said method comprising the steps of:

engaging said first and second shaft means with said first housing portion;

mounting said second housing portion on the engaged first and second shaft means of said first housing portion to establish sufficient frictional engagement between said second portion and said first and second shaft means to maintain a position of said second housing relative to said first and second shaft means;

positioning at least a supply spool of ink ribbon between said first housing portion and said second housing portion, the supply spool of ink ribbon having a width)

overcoming said frictional engagement to slidably move said second housing portion along said first and second shaft means to position said second housing portion a distance from said first housing portion, said distance corresponding to the width of the supply spool of ink ribbon and further frictionally engaging said first and second shaft means with said second housing portion to establish sufficient frictional engagement between said second housing portion and said first and second shaft means to maintain said distance between said first and second housing portions.

15. The method according to claim 14, wherein said second housing portion comprises at least first and second orifices for receiving said first and second shaft means therein, said first and second orifices having an interior surface, said first and second shaft means have an exterior surface for being disposed towards said interior surface of said first and second orifices, said exterior surfaces of said first and second shaft means and said interior surfaces of said first and second orifices defining a friction therebetween, the friction between said exterior surfaces of said first and second shaft means and said interior surfaces of said first and second orifices providing at least a substantial portion of a force for maintaining said first housing portion and said second housing portion in a substantially fixed position with respect to one another, and wherein:

said step of engaging comprises fixedly attaching said first and second shaft means to said first housing portion;

said step of mounting comprises:

inserting said first and second shaft means of said first housing portion into said first and second orifices of said second housing portion;

establishing the friction between said external surfaces of said first and second shaft means and said internal surfaces of said first and second orifices to provide the force for maintaining said first housing portion and said second housing portion in a substantially fixed position with respect to one another; and providing the force for maintaining said first housing portion and said second housing portion in a substantially fixed position with respect to one another.

16. The method according to claim 15, wherein said step of moving comprises:

applying a closing force to one of said first and second housing portions in a direction towards the other of said first and second housing portions to overcome the friction between said exterior surface of said first and second shaft means and said interior surface of said first and second orifices and slide said second housing portion along said first and second shaft means;

overcoming the friction between said exterior surface of said first and second shaft means and said interior surface of said first and second orifices; and sliding said second housing portion along said first and second shaft means.

17. The method according to claim 16, wherein: when it is desired to change the ink ribbon, said method further comprises the steps of:

applying an opening force between said first housing portion and said second housing portion to overcome the friction between said exterior surface of said first and second shaft means and said interior surface of said first and second orifices to slide said second housing portion away from said first housing portion;

removing the supply spool of ink ribbon from between said first and second housing portions;

replacing a new supply spool of ink ribbon between said first and second housing portions; and again applying a closing force to overcome the friction between said exterior surface of said first and second shaft means and said interior surface of said first and second orifices;

sliding said second housing portion along said first and second shaft means to fix said supply spool of ink ribbon therebetween;

again establishing the friction between said external surfaces of said first and second shaft means and said internal surfaces of said first and second orifices to provide the force for maintaining said first housing portion and said second housing portion in a substantially fixed position with respect to one another; and again maintaining said first housing portion and said second housing portion in a substantially fixed position with respect to one another.

18. The method according to claim 17, further comprising the steps of:

configuring at least let one of:

said external surfaces of said first and second support shaft means; and said internal surfaces of said first and second orifices, to comprise means for frictionally engaging the other said internal surfaces of said first and second orifices; and said external surfaces of said first and second support shaft means, to detachably secure said first housing portion and said second housing portion in a fixed position with respect to one another;

providing the friction between said external surface of said support shaft means and said internal surface of said orifices with said means for frictionally engaging, said friction providing the sole force for maintaining said first housing portion and said second housing portion together in a substantially fixed position with respect to one another;

providing bearing means within said cassette on at least one of said first and second housing portions for rotatably supporting a ribbon supply spool and a ribbon take-up spool between said first and second housing portions when said first housing portion is detachably secured to said second housing portion, said bearing means comprising first and second core means extending from and rotatably mounted to said second housing of portion, said first and second core means being disposed spaced apart from one another configuring said first core men for receiving at least the ribbon supply spool thereon, and configuring said second core means for receiving at least a ribbon take-up spool thereon, said first and second core means each defining a longitudinal axis, said first and second support shaft means each defining a longitudinal axis, and said longitudinal axis of each of said first and second core means being disposed substantially parallel to said longitudinal axis of each said first and second support shaft means; positioning both the ribbon supply spool and the take-up spool on said core means; and guiding the ribbon from the ribbon supply spool along a ribbon path from said ribbon supply spool about said first support shaft means, about said second support shaft means and to said take-up spool.

19. The method according to claim 18, further including the steps configuring said means for frictionally engaging as plastic bushings disposed within said first and second orifices of said second housing portion, said bushings being configured for substantially surrounding and frictionally engaging said first and second support shaft means, disposed through said first and second orifices of said second housing portion;

configuring said first core means to comprise a first core part and a second core part;

rotatably disposing said first core part on said first housing portion and rotatably disposing said second core part on said second housing portion, said first and second core parts being coaxially aligned with one another;

configuring said second core means to comprise a third core part and a fourth core art;

rotatably disposing said third core part on said first housing portion and rotatably disposing said fourth core part on said second housing portion, said third and fourth core parts being coaxially aligned with one another;

engaging a core of the ribbon supply spool with, and between said first and second core parts;

engaging a core of the take-up spool with, and between said third and fourth parts;

configuring said first core part and said second core part for receiving therein e drive shaft of the printer, the drive configuring said third core part end said fourth core part for receiving therein a take-up shaft of the printer, the take-up shaft for rotating said second core means, the drive shaft and the take-up shaft each having a plurality of teeth, and at least one of said first core part and said second core part, and one of said third core part and said fourth core part, comprising teeth for engaging with the teeth of the drive shaft and the take-up shaft;

configuring said first housing portion as a first plate and said second housing portion as a second plate;

providing each of said first and second plates with first and second arm portions extending therefrom, said first and second arm portions each having a first end adjacent said first and second plates, and a second end disposed away from said first and second plates;

disposing said first and second plates substantially parallel to one another when detachably secured to one another;

providing two additional ribbon guide pins for guiding the printing ribbon from the ribbon supply spool to the ribbon take-up spool, said two additional guide pins each define a longitudinal axis, said longitudinal axis of each of said two additional guide pins are disposed parallel to said longitudinal axes of said first and second core means and of said first and second support shaft means, said longitudinal axes of said first and second core means define a first plane, said longitudinal axes of said first and second support shaft means define a second plane, said longitudinal axes of said two additional guide pins define a third plane, and said first, second and third planes being disposed parallel to one another with said second plane disposed between said first and third planes;

disposing said two additional guide pins at said second ends of said first and second arm portions;

providing additional corresponding orifices at said second ends of said first and second arm portions of said second plate;

providing corresponding bushings disposed within said orifices, for passage of said two additional guide pins therethrough; and fixedly attaching a first end of each of said two additional guide pins to said second ends of said first and second arm portions of said first plate; and disposing a second end of each of said two additional guide pins through said corresponding orifices of said second ends of said first and second arm portions during said mounting of said second housing portion on said first housing portion to provide further friction for maintaining said first housing portion and said second housing portion in substantially fixed position with respect to one another.

20. A reusable ribbon cassette for a printer for printing labels on a label material, the cassette being capable of accommodating ribbons having different widths, the printer being configured for transferring a printing substance from a printing ribbon to the label material, the printer comprising: means for storing label material to be printed upon; means for storing printing ribbon, the printing ribbon comprising a printing substance thereon; at least one printing element for printing on the label material, the at least one printing element comprising means for transferring the printing substance from the printing ribbon to the label material; means for actuating the at least one printing element to transfer printing substance from said printing ribbon to the label material to print on the label material; and said means for storing printing ribbon comprising said reusable cassette;

said reusable cassette comprising:

a first housing portion;

a second housing portion;

said first and second housing portions comprising means for holding a supply of printing ribbon therebetween;

at least first and second support shaft means, said first and second support shaft means being spaced apart from one another and extending at least between said first and second housing portions for variably positioning said first and second housing portions with respect to one another to accommodate printing ribbons of different widths therebetween;

said first support shaft means having a first end adjacent said first housing portion and a second end, said second end comprising a portion adjacent said second housing portion;

said second support shaft means having a first end adjacent said first housing portion and a second end, said second end comprising a portion adjacent said second housing portion;

at least one of said first housing portion and said second housing portion comprising corresponding openings therein for receiving said first and second support shaft means therethrough for relatively positioning said first and second housing portions with respect to one another;

said first and second support shaft means disposed through said corresponding openings comprise a frictional engagement between said first and second support shaft means and said openings;

said frictional engagement between said first and second support shaft means and said corresponding openings being sufficient for substantially minimizing movement of said first and second housing portions with respect to one another;

said first and second support shaft means each define a corresponding longitudinal axis, and said first and second support shaft means each comprise a corresponding external surface disposed to face radially outwardly away from its corresponding longitudinal axis, said external surface of each of said first and second support shaft means defining a plurality of straight line segments parallel to its corresponding longitudinal axis;

said openings in said at least one of said first and second housing portions each define a corresponding longitudinal axis, and said at least one of said first and second housing portions comprise a corresponding surface surrounding and defining each said opening, each said surface comprising an internal surface facing radially inwardly towards its corresponding longitudinal axis;

each of:

said first support shaft means and said at least one of said first and second housing portions, and said second support shaft means and said at least one of said first and second housing portions, comprise sliding contact therebetween, said sliding contact comprising sliding contact between said internal surfaces of said at least one of said first and second housing portions and said external surfaces of said first shaft means and said second shaft means; and said sliding contact between said internal surfaces of said at least one of said first and second housing portions and said external surfaces of said first shaft means and said second shaft means solely provides said frictional engagement sufficient for substantially minimizing movement of said first and second housing portions with respect to one another to maintain said first and second housing portions together frictionally during use of the cassette.

21. The cassette according to claim 20, further comprising said frictional engagement of said sliding contact being solely sufficient for detachably securing said at least one of said first and second housing portions in a fixed position with said first and second support shaft means during use of the cassette.

22. The cassette according to claim 20, wherein:

said external surfaces comprise smooth, uninterrupted cylindrical surfaces extending between said first and second ends thereof;

said openings comprise circular openings;

said first end of each of said first and second support shaft means is fixedly attached to said first housing portion;

said second housing portion comprises said openings therethrough; and said second end of each of said first and second support shaft means is disposed through a corresponding one of said openings of said second housing portion.

23. A reusable ribbon cassette for a printer for printing labels on a label material, the cassette being capable of accommodating ribbons having different widths, the printer being configured for transferring a printing substance from a printing ribbon to the label material, the printer comprising: means for storing label material to be printed upon; means for storing printing ribbon, the printing ribbon comprising a printing substance thereon; at least one printing element for printing on the label material, the at least one printing element comprising means for transferring the printing substance from the printing ribbon to the label material; means for actuating the at least one printing element to transfer printing substance from said printing ribbon to the label material to print on the label material; and said means for storing printing ribbon comprising said reusable cassette;

said reusable cassette comprising:

a first housing portion;

a second housing portion;

said first and second housing portions comprising means for holding a supply of printing ribbon therebetween;

at least first and second support shaft means, said first and second support shaft means being spaced apart from one another and extending at least between said first and second housing portions for variably positioning said first and second housing portions with respect to one another to accommodate printing ribbons of different widths therebetween;

said first support shaft means having a first end adjacent said first housing portion and a second end, said second end comprising a portion adjacent said second housing portion;

said second support shaft means having a first end adjacent said first housing portion and a second end, said second end comprising a portion adjacent said second housing portion;

said first end of each of said first and second support shaft means is fixedly attached to said first housing portion;

said second housing portion comprising corresponding openings therein for receiving said first and second support shaft means therethrough for relatively positioning said first and second housing portions with respect to one another;

said second end of each of said first and second support shaft means is disposed through a corresponding one of said openings of said second housing portion; and said first and second support shaft means together with said corresponding openings comprise means for detachably securing said second housing portion and said first and second support shaft means in a fixed position with respect to one another;

said first and second support shaft means comprise substantially smooth, uninterrupted surfaces extending between said first and second ends thereof;

said openings in said second housing portion comprise a surface for contacting said surface of one of said first and second support shaft means; and said means for detachably securing comprises means for frictionally engaging said surfaces of said first and second support shaft means with said surfaces of said openings to provide frictional engagement between said first and second support shaft means and said openings, and said frictional engagement being sufficient for detachably securing said first housing portion and said second housing portion in a fixed position with respect to one another.

24. The cassette according to claim 23, wherein said means for holding a supply of ribbon comprises bearing means disposed on at least one of said first and second housing portions for rotatably supporting a ribbon supply spool and a ribbon take-up spool between said first and second housing portions when said first housing portion is detachably secured to said second housing portion.

* * * * *

UNITED STATES PATENT AND TRADEMARK OFFICE

CERTIFICATE OF CORRECTION

PATENT NO. : 5,553,952

DATED : September 10, 1996

INVENTOR(S) : Dirk UMBACH

It is certified that error appears in the above-indentified patent and that said Letters Patent is hereby corrected as shown below:

On the title page, item [56], under the "U.S. PATENT DOCUMENTS" section, after '4,673,304', delete "6/1984" and insert --6/1987--.

In column 3, line 17, after 'core', delete "Here" and insert --were--.

In column 20, line 17, after 'the', delete "counter presser" and insert --counterpressure--.

In column 31, line 40, Claim 13, after the second occurrence of 'said', delete "sleeve-shape" and insert --sleeve-shaped--.

In column 31, line 45, Claim 13, after the second occurrence of 'said', delete "sleeve-shape" and insert --sleeve-shaped--.

In column 32, line 22, Claim 14, before 'least', delete "et" and insert --at--.

In column 32, line 32, Claim 14, after the first occurrence of 'second' insert --housing--.

In column 32, line 37, Claim 14, after 'a', delete "width)" and insert --width;--.

In column 33, line 59, Claim 18, after 'least' delete "let".

UNITED STATES PATENT AND TRADEMARK OFFICE

CERTIFICATE OF CORRECTION

PATENT NO. : 5,553,952

DATED : September 10, 1996

INVENTOR(S) : Dirk UMBACH

It is certified that error appears in the above-indentified patent and that said Letters Patent is hereby corrected as shown below:

In column 33, line 63, Claim 18, after 'other' insert --of:--.

In column 34, line 18, Claim 18, before 'portion,' delete "of".

In column 34, line 36, Claim 19, after 'steps' insert --of:--.

In column 34, line 51, Claim 19, after the second occurrence of 'core', delete "art;" and insert --part;--.

UNITED STATES PATENT AND TRADEMARK OFFICE

CERTIFICATE OF CORRECTION

PATENT NO. : 5,553,952

DATED : September 10, 1996

INVENTOR(S) : Dirk Umbach

It is certified that error appears in the above-indentified patent and that said Letters Patent is hereby corrected as shown below:

In column 34, line 63, Claim 19, after 'therein', delete "e" and insert --a--.

In column 34, line 64, Claim 19, after 'drive' insert --shaft for rotating said first core means;--.

In column 34, line 65, Claim 19, after the first occurrence of 'part', delete "end" and insert --and--.

Signed and Sealed this

Fourth Day of March, 1997

*Attest:*

*Attesting Officer*

Bruce Lehman

BRUCE LEHMAN

*Commissioner of Patents and Trademarks*